US010086258B2

(12) United States Patent
Prucey

(10) Patent No.: US 10,086,258 B2
(45) Date of Patent: Oct. 2, 2018

(54) SYSTEMS AND METHODS FOR ALLOWING PLAYERS TO PLAY POKER GAMES USING GAME TILES INCLUDING MULTIPLE PLAYING CARD SYMBOLS

(71) Applicant: Canned Bananas LLC, New York, NY (US)

(72) Inventor: James Prucey, New York, NY (US)

(73) Assignee: CANNED BANANAS LLC, New York, NY (US)

( * ) Notice: Subject to any disclaimer, the term of this patent is extended or adjusted under 35 U.S.C. 154(b) by 332 days.

(21) Appl. No.: 14/690,160

(22) Filed: Apr. 17, 2015

(65) Prior Publication Data

US 2015/0297978 A1 Oct. 22, 2015

Related U.S. Application Data

(60) Provisional application No. 61/981,428, filed on Apr. 18, 2014.

(51) Int. Cl.
*G07F 17/32* (2006.01)
*A63F 1/02* (2006.01)

(52) U.S. Cl.
CPC ..... *A63F 1/02* (2013.01); *G07F 17/3244* (2013.01); *G07F 17/3293* (2013.01); *A63F 2001/027* (2013.01)

(58) Field of Classification Search
CPC ..... G07F 17/3244; G07F 17/3293
See application file for complete search history.

(56) References Cited

U.S. PATENT DOCUMENTS 212,239 A * 2/1879 Schick ..... B21B 1/166 256/7
712,566 A * 11/1902 Moller ..... A63F 1/02 273/304
821,781 A * 5/1906 Cadwallader ..... A63F 1/02 273/304
1,551,761 A * 9/1925 McCarroll ..... A63F 1/02 273/304
1,568,206 A * 1/1926 Brandt ..... A63F 1/02 273/296
D169,847 S 6/1953 Inman
D212,239 S 9/1968 Schick
D222,490 S 10/1971 Alaska
4,050,698 A 9/1977 Brown
5,280,916 A * 1/1994 Gleason, Jr. ..... A63F 1/02 273/304
5,445,391 A * 8/1995 Gleason, Jr. ..... A63F 1/02 273/138.1

(Continued)

FOREIGN PATENT DOCUMENTS

WO 2008/111984 A2 9/2008

*Primary Examiner* — Omkar Deodhar
*Assistant Examiner* — Shauna-Kay Hall
(74) *Attorney, Agent, or Firm* — Howard & Howard Attorneys PLLC

(57) ABSTRACT

A deck of playing cards for use in playing a game is described herein. The deck of playing cards includes a plurality of playing cards including a plurality of card symbols. The plurality of card symbols are selected from a set of card symbols. Each playing card includes a set of card symbols including at least three card symbols. Each card symbol has an associated rank and suit and each of the card symbols being different.

12 Claims, 25 Drawing Sheets

(56) References Cited

U.S. PATENT DOCUMENTS

| | | | | |
|---|---|---|---|---|
| 5,586,764 | A | 12/1996 | Katz | |
| 5,697,616 | A | 12/1997 | Wilyard | |
| 5,863,040 | A | 1/1999 | Van Gass | |
| 7,156,398 | B1 | 1/2007 | Phillips | |
| 7,481,435 | B2 | 1/2009 | Shetterly | |
| 7,988,153 | B2 | 8/2011 | Chang | |
| 2005/0093229 | A1* | 5/2005 | Dewayne | A63F 1/00 273/146 |
| 2008/0237984 | A1* | 10/2008 | Kling | A63F 1/00 273/292 |
| 2009/0322024 | A1* | 12/2009 | Sorge | A63F 1/04 273/146 |
| 2012/0244924 | A1* | 9/2012 | Willis | A63F 3/00157 463/12 |
| 2012/0326390 | A1 | 12/2012 | Hoyt et al. | |
| 2014/0117620 | A1 | 5/2014 | Kennedy | |

* cited by examiner 2x 3 of a kind

6-Card Flush

6-Card Straight Flush

5-Card Flush

5-Card Flush

5-Card Straight Flush

5-Card Straight Flush

SYSTEMS AND METHODS FOR ALLOWING PLAYERS TO PLAY POKER GAMES USING GAME TILES INCLUDING MULTIPLE PLAYING CARD SYMBOLS

CROSS-REFERENCE TO RELATED APPLICATION

This application claims priority to U.S. Provisional Application No. 61/981,428, filed Apr. 18, 2014, the disclosure of which is hereby incorporated by reference in their entirety for all purposes.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to a system for allowing players to play poker-type games and more particularly, to methods and systems for allowing players to play poker-type games with game tiles including a plurality of playing cards.

BACKGROUND OF THE INVENTION

Card games, such as Blackjack and "Texas Hold'em" poker, are very popular with players. At least some known systems allow a plurality of players to play online poker-type games via a plurality of client devices that are connected together via the internet. During play of known online poker games, each player is dealt a hand including a set of cards being dealt from a common deck of playing cards, and places wagers based on the associated dealt hand. The game of poker is well known, including several variations of poker rules. For example, at least some known poker-type game such as, for example, "Texas Hold'em" provide each player two cards dealt face down from the common deck, after which five community cards are dealt face up from the common deck. Each player's hand is determined based on the two dealt cards and three of the five community cards. Betting rounds may occur after each player receives the two cards, after three community cards have been dealt (called the "flop"), after a fourth community card has been dealt (the "turn"), and after a fifth community card has been dealt (the "river"). In addition, antes and/or blinds may be required to bet a predefined fixed amount into a "pot" in order to participate in the round and prior to the cards being dealt. Any amount included in the "pot" may be distributed to the player having a winning card hand. During each betting round, each player may decide to remain in the round by placing and/or checking a bet or to leave the round by relinquishing any bets to the "pot" and "folding" their card hand. At the completion of the final betting round, each of the remaining player displays the player's two dealt cards in a "showdown", and the value of each remaining player's hand is determined based on the player's two cards and three of the five community cards to form a five card poker hand, with the poker hands being ranked in standard poker fashion, such as, for example, royal flush, straight flush, four of a kind, full house, flush, straight, three of a kind, two pair, one pair, and high card, in descending order. The player having the highest poker hand is the game winner.

In addition, players of known on-line poker systems face challenges including: 1) length of hands can be long with the players folding more than actually being involved in the hands; 2) Texas Hold'em is optimized for 10 players; 3) The percentage of player who will be in the hand till the end is low; and 4) Odds can be difficult to learn and be confusing. In addition, players of known on-line current systems may jump to a new table after a fold, thus defeating the social aspect of poker. In addition, some known systems allow for 5-player games, known as short-handed games, which are not preferable.

Over time, players may become frustrated because dealing each player hand and each community cards may take significant time during the game, thus increasing the time required to play a round of the game. Accordingly, new features are necessary to appeal to player interest and enhance excitement in order to entice longer play and increased profitability. Thus, there continues to be a need for new games to compete with or replace the most popular games being played today. The present invention is directed to satisfying these needs.

SUMMARY OF THE INVENTION

In different embodiments of the present invention, systems, methods, and computer-readable storage media for providing a game to players with playing cards having multiple card symbols.

In one embodiment, a method of playing a poker-type game with game tiles is provided. Each game tile includes a plurality of playing cards that are selected from a predefined set of playing cards. The method includes distributing a player game tile to each of the participating players and conducting a first round of betting. The method also includes distributing a first community game tile, conducting another betting round, distributing a second community tile, and conducting a final betting round. The outcome of the poker-type game is determined as a function of the value of each player hand being defined as the corresponding player game tile and the first and second community game tiles. The value of the player hand is determined as a function of one or more playing cards being included in the associated player hand.

In another embodiment a deck of playing cards for use in playing a game is provided. The deck of playing cards includes a plurality of playing cards including a plurality of card symbols. The plurality of card symbols are selected from a set of card symbols. Each playing card includes a set of card symbols including at least three card symbols. Each card symbol has an associated rank and suit and each of the card symbols being different.

In yet another embodiment, a method of providing a game to participating players is provided. The method includes receiving a wager from at least one of the participating players, and distributing a player card to each of the participating players. Each player card is selected from a deck of playing cards. The deck of playing cards includes a plurality of playing cards including a plurality of card symbols. The card symbols are selected from a set of card symbols. Each playing card includes at least three card symbols. Each card symbol has an associated rank and suit, each of the three card symbols being different. The method includes distributing a community card from the deck of playing cards, determining a hand value of each player hand as a function of the card symbols being displayed with the community card and the card symbols being displayed with the corresponding player card, determining a winning player hand as a function of the corresponding hand value, and settling each receiving wager by either awarding a payout amount to the winning player or collecting the wager.

In another embodiment, one or more non-transitory computer-readable storage media, having computer-executable instructions embodied thereon are provided. When executed by at least one processor, the computer-executable instructions cause the processor to receive a wager from at least one of the participating players and distribute a player card to each of the participating players. Each player card is selected from a deck of playing cards. The deck of playing cards includes a plurality of playing cards including a plurality of card symbols. The card symbols are selected from a set of card symbols. Each playing card of the plurality of playing cards includes at least three card symbols. Each card symbol has an associated rank and suit, and each of the three card symbols is different. The processor distributes a community card from the deck of playing cards, determines a hand value of each player hand as a function of the card symbols being displayed with the community card and the card symbols being displayed with the corresponding player card, determines a winning player hand as a function of the corresponding hand value, and settles each wager by either awarding a payout amount to the winning player or collecting the wager.

BRIEF DESCRIPTION OF THE DRAWINGS

Other advantages of the invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
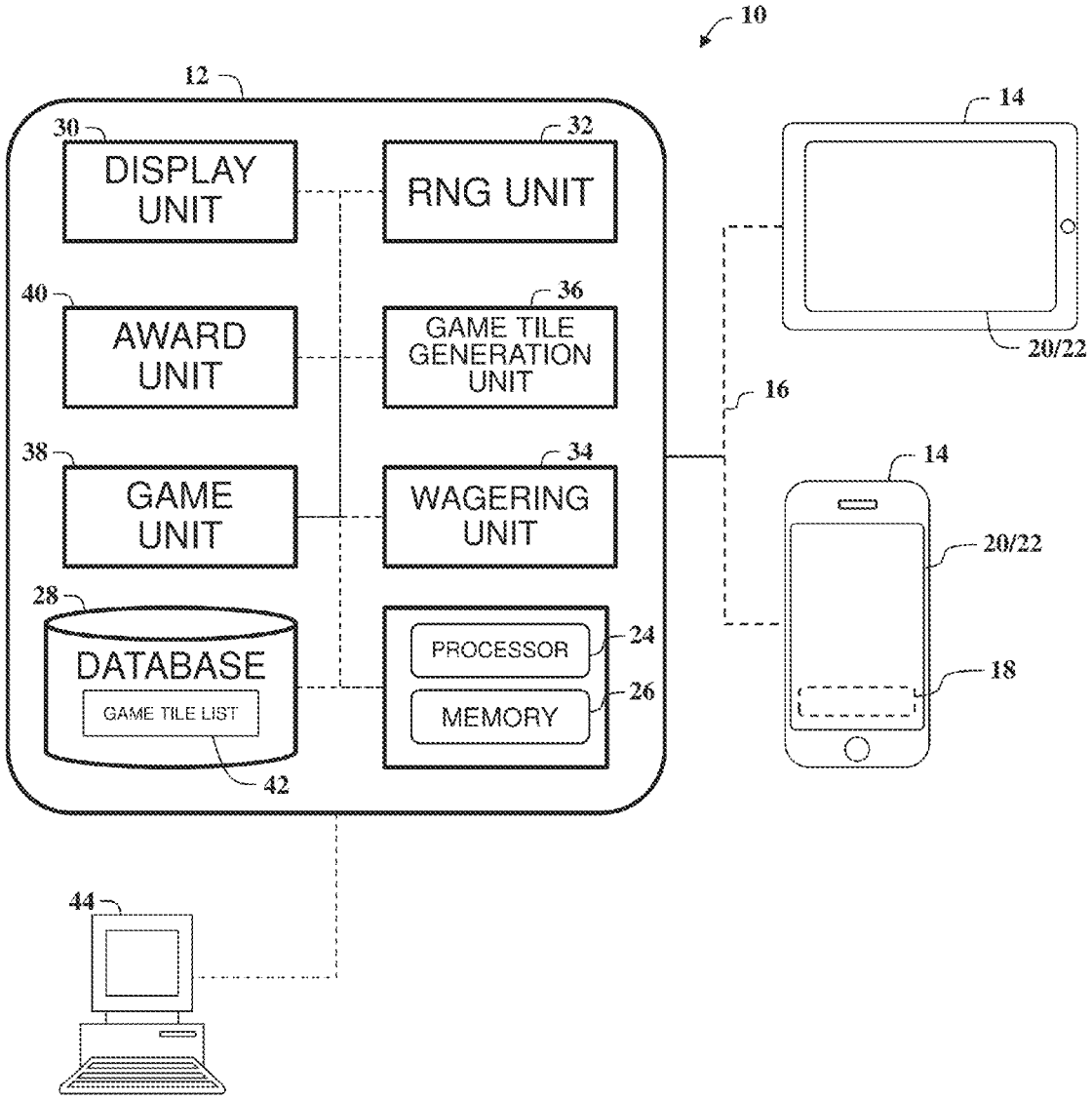
FIG. 1 is a schematic representation of an exemplary system for allowing a player to play a poker-type game via a user computing device, according to an embodiment of the invention.

The present invention overcomes the disadvantages of known poker games by providing a system and deck of playing cards that 1) reduce the number of players required for the game; 2) reduce the number of betting rounds; 3) increase the player's activity through the hand including the final bet; 4) maintain the positive aspects of poker, e.g. odds, advantage, bluffing, position, etc.; 5) increase the number of games player per hour, thus increasing the rake (e.g. Casino cut); and 6) creating easier barriers to entry for players to participate in games.

The invention is generally directed to methods and systems of providing a card-type game that includes game tiles having multiple playing cards. With reference to the drawings and in operation, the present invention overcomes at least some of the disadvantages of known systems by providing a system that allows a plurality of players to play a card-type game that includes a plurality of game tiles, with each game tile including a plurality of playing cards. The system may distribute each player tile to each of the participating players, distribute one or more community tiles, and determine each player hand as a function of the associated player tile and the community tiles. Moreover, the system may determine a player hand associated with each player based on one or more playing cards displayed in each associated game tile.

In one embodiment, the present invention includes a physical deck of playing cards for use in card-type games. The deck of playing cards includes a plurality of playing cards each having a plurality of card symbols. Each of the card symbols includes an associated rank and suit and each playing card includes different card symbols. Each playing card includes a pair of card symbols that have the same suit, and a pair cards symbols that have different suits. In addition, each playing card includes card symbols having different ranks.

In the illustrated embodiment, the deck of playing cards includes twenty playing cards including sixty playing card symbols. The playing card symbols are selected from a group of card rank including Ace (A), King (K), Queen (Q), Jack (J), Ten (10), and Nine (9). The deck of playing cards contains every 3 card combination of the 6 rank values, for example AKQ, AKJ, AK10, AK9, AQJ, AQ10, AQ9 and so on until all 20 are completed. On each playing card is 2 card symbols of one suit and 1 of another suit. Each deck of 20 playing cards contains all 24 card values (cards 9-A of Clubs, Diamonds, Spades and Hearts) twice, plus half of this group of card values an additional time (24+24+12 half=60) 60 card values/3 on each card sets=20 playing cards. The deck includes fifteen card symbols of each card suit: clubs, diamonds, spades, and hearts (4×15=60). The deck also includes ten card symbols of each rank: Ace, King, Queen, Jack, Ten, and Nine (4×10=60). In addition, every 2 rank combo is represented 4 times, for example A-K is represented with each or the other 4 ranks. Moreover, the deck includes 5 playing cards that have 2 card symbols of each suit (4 suits×5 playing cards)=20 playing cards.

Figure 38:
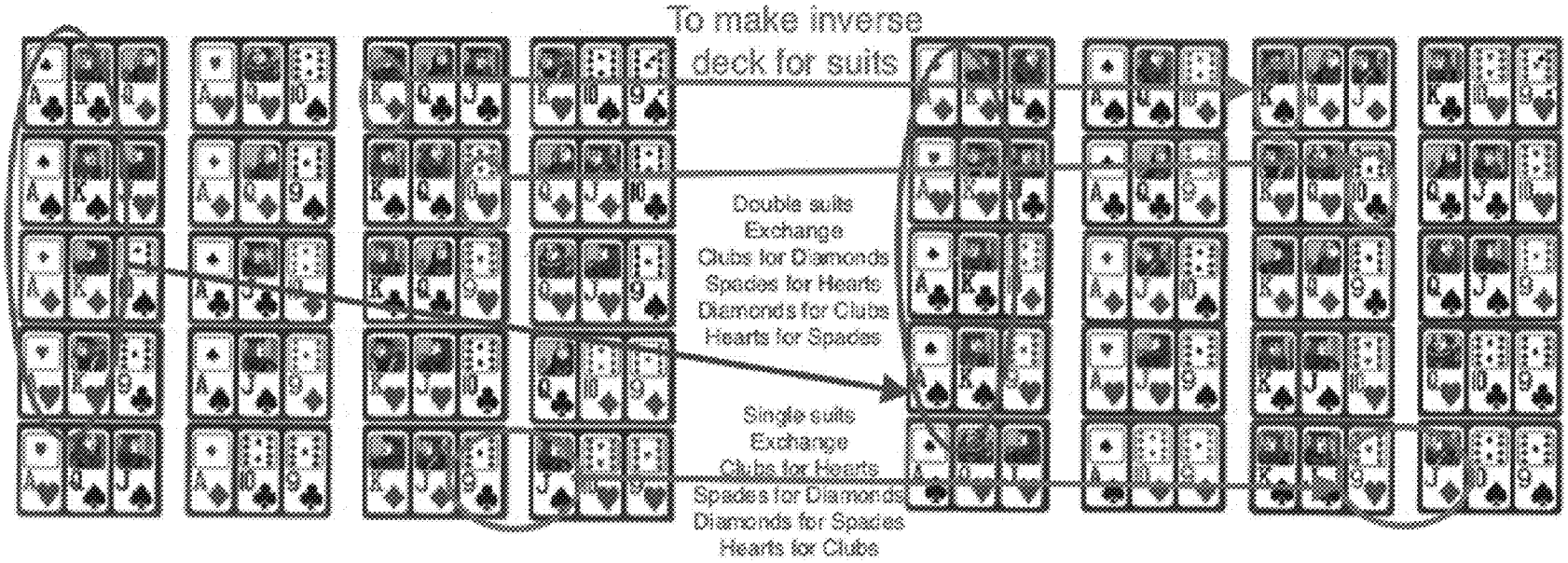
FIG. 38 is an illustration of decks of playing cards that may be used with the method shown in FIG. 2, according to an embodiment of the present invention.

In one embodiment, the deck of playing cards may include Double Decks (shown in FIG. 38), including two decks that are inverse of each other meaning it contains all 24 individual cards 9-A of Clubs, Diamonds, Spades and Hearts, 5 times each (24+24+12 half+24+24+12 other half) for a total of 40 playing cards. For example, as shown in FIG. 38, in one embodiment, the double deck may include an inverse double deck to make an 80 card deck. This can be accomplished by taking all 40 of these cards and for each rank regardless of a single or double, swap the blacks and swap the reds, e.g. 1) Exchange all Spades with Clubs; 2) Exchange all Clubs with Spades; 3) Exchange all Diamonds with Hearts: and 4) Exchange all Hearts with Diamonds. For example, the two #20 cards (top left in each deck) in the inverse of the double deck would be [Ace Spade, King Spade. Queen Hearts] and [Ace hearts, King Hearts, Queen Clubs].

The exemplary embodiments herein relate to wagering games. It should be understood that each of the methods and individual steps recited herein may be partially or wholly carried out in a variety of ways and/or systems, which may include, but are not limited to, a live dealer physically dealing game tiles in a casino, an electronic gaming machine (EGM) for use by one or more players, a multiplayer platform which may include a player interface such as a touchscreen display and involve physical or virtual game tiles, dealer and wagering chips, a home computer or portable computing device, such as a tablet computer or mobile phone capable of communicating with a network or over the Internet, global telecommunication network or world wide web.

In one embodiment, the present invention includes a method of playing a poker-type game with game tiles. Each game tile includes a plurality of playing card symbols that are selected from a predefined set of playing card symbols. In one embodiment, each game tile includes three playing card symbols that are selected from a predefined set of playing card symbols that includes playing card symbols having a plurality of ranks including face cards such as, for example, an Ace, King, Queen, and Jack, and number cards such as, for example, a ten, nine, eight, seven, six, five, four, three, and two ranked in descending order of value, and being associated with a plurality of card suits including spades, diamonds, clubs, and hearts. In the illustrated embodiment, the game tile deck includes 20 game tiles, each including 3 playing card symbols that are selected from a predefined set of playing card symbols including card symbols having card suits including spades, diamonds, clubs, and hearts and card ranks including Ace, King, Queen, and Jack, Ten and Nine. Each of the 6 ranks (A, K, Q, J, 10, 9) is included in 10 game tiles. Each of the 4 suits (spades, diamonds, clubs, and hearts) is displayed 15 times, twice on 5 game tiles and once on 5 game tiles (see FIGS. 7, 13-15). In addition, each 2-rank combination is displayed on 4 game tiles included in the game tile deck (see FIG. 7, 13-15). Moreover, in one embodiment, the game tile deck may include a plurality of game tiles having predefined combinations of playing card symbols for use in obtaining a predefined number of player hand values (see FIGS. 19-27) during game play.

The method includes distributing a player game tile to each of the participating players and conducting a first round of betting. The method also includes distributing a first community game tile, conducting another betting round, distributing a second community tile, and conducting a final betting round. The outcome of the poker-type game is determined as a function of the value of each player hand being defined as the corresponding player game tile and the first and second community game tiles. The value of the player hand is determined as a function of one or more playing card symbols being included in the associated player hand.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a schematic representation of the system 10, according to an embodiment of the invention. In the illustrated embodiment, the system 10 includes a system controller 12 that is coupled to one or more user computing devices 14 to allow a plurality of players to simultaneously participate in a game. Each user computing device 14 is configured to transmit and receive data to and/or from the system controller 12 to display graphical interfaces (shown in FIGS. 3-6, 9-12, 29, and 37) to enable a user to participate in card-type games with the user computing device 14. In another embodiment, the user computing device 14 may include a personal computer, laptop, cell phone, tablet computer, smartphone/tablet computer hybrid, personal/home video game device, personal data assistant, and/or any suitable computing device that enables a user to connect to the system controller 12 and display the graphical interfaces. In the illustrated embodiment, the system controller 12 is coupled to each user computing device 14 via a communications link 16 that enables each user computing device 14 to access system controller 12 over a network such as, for example, the Internet, a cellular telecommunications network, a wireless network and/or any suitable telecommunication network that enables the user computing devices 14 to access the system controller 12. For example, in one embodiment, the user computing device 14 includes a mobile computing device, e.g. a smartphone that communicates with the system controller 12 via the cellular telecommunications network and/or the Internet.

In the illustrated embodiment, each user computing device 14 includes a controller 18 that is coupled to a display device 20 and a user input device 22. The controller 18 receives and transmits information to and from the system controller 12 and displays the graphical interfaces (shown in FIGS. 3-6, 9-12 and 37) on the display device 20 to enable the user to interact with the system controller 12 to play the games in accordance with the embodiments described herein. The display device 20 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 22 may include, without limitation, a keyboard, a touch-sensitive screen, a scroll wheel, a pointing device, and/or any suitable device that enables a user to input data into the controller 18 and/or to retrieve data from the controller 18. Alternatively, a single component, such as a touch screen, a capacitive touch screen, and/or a touchless screen, may function as both the display device 20 and as the user input device 22.

In the illustrated embodiment, the system controller 12 includes a processor 24, a memory device 26, a database 28, a display unit 30, a random-number generator (RNG) unit 32, a wagering unit 34, a game tile generation unit 36, a game unit 38, and an award unit 40.

The memory device 26 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 24 to store, retrieve, and/or execute instructions and/or data.

The processor 24 executes various programs, and thereby controls other components of the system controller 12 and the user computing device 14 according to user instructions and data received from the user computing devices 14. The memory device 26 stores programs and information in the database 28 that may be used by the processor 24. Moreover, the memory device 26 stores and retrieves information in the database 28 including, but not limited to, image data for producing images and/or screens on the display device 20, and temporarily stores variables, parameters, and the like that are used by the processor 24. In addition, the memory device 26 may store a game tile list 42 that includes a plurality of game tiles that may be used to form a game tile deck for use in playing a game. In addition the memory device 26 may store a game list that includes a plurality of games that may be played with the game tiles. Each game included in the game list may be associated with a different game rule including, but not limited to, slots, farkle, Joker poker, poker, poker-based games, Draw, No-Peek, Limit, No-Limit, Stud, Texas Hold'em, Omaha, blackjack, solitaire, solitaire-based games, hearts, war, baccarat, gin-rummy, bridge, spades, matching-type games, and/or any suitable card-based game.

The database 28 contains information on a variety of matters, such as, for example, account information related to a user, user profile information, a game type, a number of game tiles associated with a game, playing cards, decks of playing cards, game tile decks associated with a game, playing card symbols associated with each game tile, player hands associated with a game, playing card symbols associated with a player hand, number of game outcomes, winning player hands, play hand values, a payout value associated with each winning hand and/or game outcome, wagers, wager amounts, number and type of cards included in each game tile, number and type of game tiles including in each game tile deck, and/or image data for producing game images and/or screens on the user computing device 14 and temporarily stores variables, parameters, and the like that are used by the system controller 12.

In the illustrated embodiment, the system controller 12 may be connected to an administrator workstation 44. The administrator workstation 44 may include a display and user input device to enable an administrative user to access the system controller 12 to periodically update the playing cards, playing card symbols, decks of playing cards, the game list, game rules, game tiles, game types, wager types, available awards, user profile accounts, and/or any suitable data and information that enables the system 10 to function as described herein.

The display unit 30 controls the display device 20 to display various images on the display device 20 preferably by using computer graphics and image data stored in the database 28. More specifically, the display unit 30 controls the images and symbols being displayed in a game such as, for example, a poker-type game 46 (shown in FIGS. 3-6, 9-12, and 37) on the display device 20 by using computer graphics and the image data. In one embodiment, the display unit 30 is configured to display a game screen 48 (shown in FIGS. 3-6, 9-12, and 37) to display information and images associated with the poker-type game 46 including information associated with each player participating in the poker-type game 46. For example, in the illustrated embodiment, the system controller 12 may display a game screen including current players and/or associated game tiles and each game tile being associated with other players that are participating in the game.

The wagering unit 34 communicates with the game unit 38 to manage the amount of player's betting credits and/or monetary funds available for use in playing the poker-type game 46. The wagering unit 34 generates and displays a betting account including an amount of betting credits available to the player for use in placing bets. During each round of the game, the wagering unit 34 may receive a request from the player to place a bet and responsively places the bet and deducts the corresponding bet amount from the betting account.

The game unit 38 includes a game program for use in playing a game based on player input receive from a user computing device 14. The game unit 38 retrieves game information included in the database 28 and performs various functions and calculations to play the game according to a set of predetermined game rules and player input. More specifically, the game unit 38 retrieves game elements from the database 28 and causes the display unit 30 to display the game 46 on the display device 20. The game unit 38 receives signals indicative of a player selection via the user input device 22 and generates an outcome of the game 46 based on the predetermined game rules and the received player selection, and displays the game outcome on the display device 20.

The RNG unit 32 generates and outputs random numbers to the game unit 38 for use in playing the game 46. In addition, the game unit 38 may use random numbers generated by the RNG unit 32 to determine if a winning condition has occurred in the outcome of the game, and to determine whether or not to provide an award to a player. For example, if the game is a poker-type game 46, the game unit 38 uses the RNG unit 32 to randomly select one or more game tiles 50 to be included in a game tile deck 52 and/or to randomly select one or more game tiles 50 from the game tile deck 52 to form a corresponding player hand 54 and/or a community hand 56, respectively. In addition, in one embodiment, the RNG unit 32 may randomly select one or more playing cards symbols to be included in a playing card and/or select one or more playing cards being included in the deck of playing cards.

In the illustrated embodiment, the award unit 40 determines a total amount of bets received during each round of the game and generates and stores the total bet amount in the database 28. The award unit 40 may also responsively provide an award to each identified player determined as a function of the total bet amount. In one embodiment, the game unit 38 may determine an outcome of the poker-type game 46 and transmit the game outcome to the award unit 40 including an identification of one or more players achieving a winning player hand. For example, in one embodiment, the poker-type game 46 may include a plurality of winning poker hands, each having an associated value such as, for example, royal flush, straight flush, four of a kind, full house, flush, straight, three of a kind, two pair, one pair, and high card, ranked in descending order. The game unit 38 may determine a winning player hand as a function of the value of each associated player hand and the ranked winning poker hands.

Figure 36:
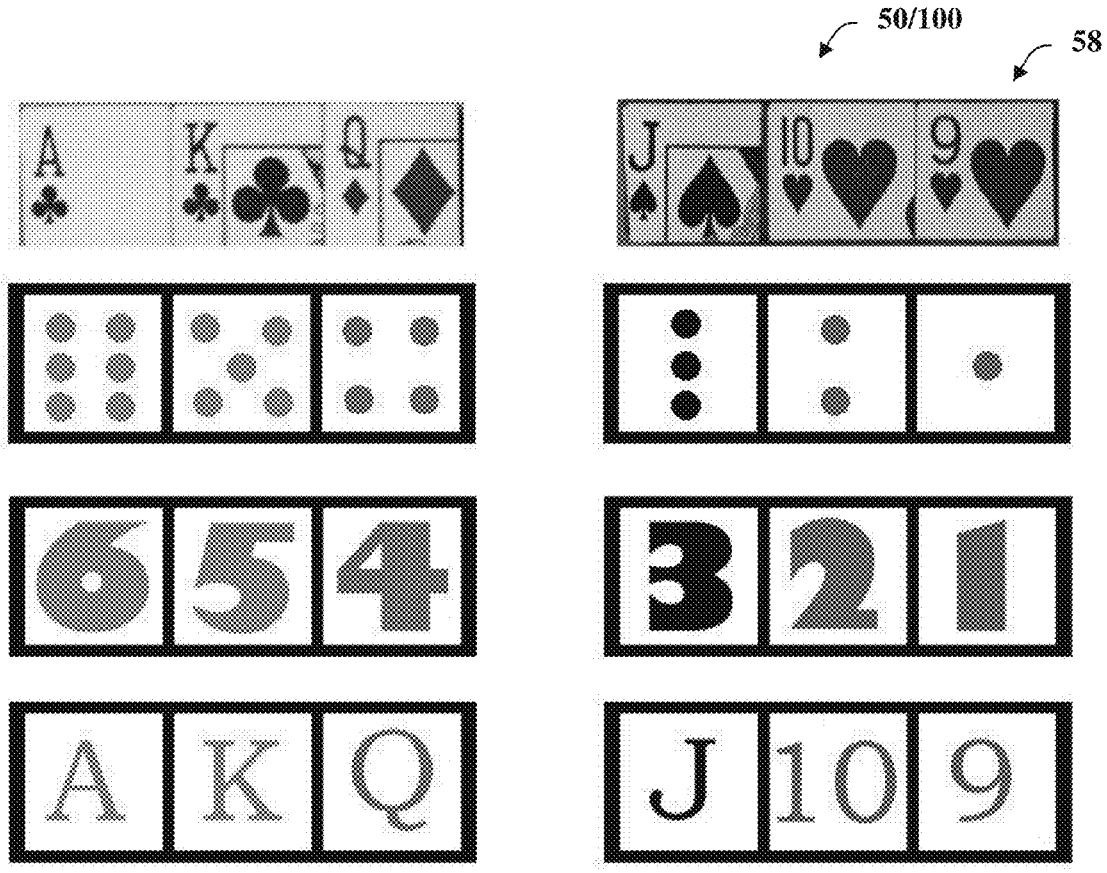
FIG. 36 is an illustration of playing card symbols that may be used with the game tiles shown in FIGS. 7 and 13, and with the deck of playing cards shown in FIGS. 14 and 15, and the dice shown in FIGS. 30-33, according to embodiments of the present invention.
Figure 37:
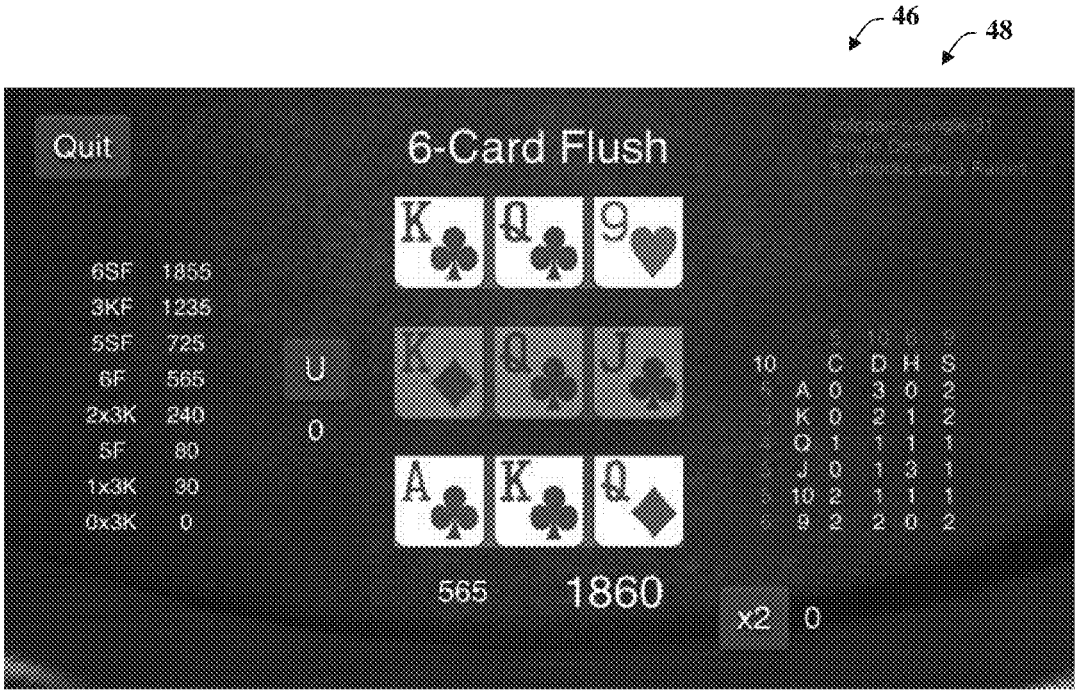
FIG. 37 is an exemplary entertaining graphical displays of a card-type game that may be used with the method shown in FIG. 2, according to an embodiment of the present invention.

The game tile generation unit 36 generates and stores a plurality of game tiles 50 in the game tile list 42. In addition, the game tile generation unit 36 may generate one or more game tile decks 52 (shown in FIGS. 7 and 13) including a plurality of game tiles 50 for use with the poker-type game 46. Each game tile 50 includes a set of playing card symbols 58. In one embodiment, the each game tile 50 includes 3 playing card symbols 58 that are selected from a predefined set of playing card symbols that includes playing card symbols having a plurality of ranks including face cards such as, for example, an Ace, King, Queen, and Jack, and number cards such as, for example, a ten, nine, eight, seven, six, five, four, three, and two, ranked in descending order of value, and being associated with a plurality of card suits including spades, diamonds, clubs, and hearts. In one embodiment, as shown in FIG. 36, the game tile may include one or more game symbols including, but not limited to, numbers, letters, characters, images, sounds, shapes, colors, dice used in a dice game, roulette-type game symbols, bingo-type game symbols, and/or any suitable game symbol. For example, other icons such as symbols and or color, e.g. a rank can be anything for example 6 fruits or 6 colors and a suits can be anything for example 4 fruits or 4 colors.

In the illustrated embodiment, the game tile deck 52 includes 20 game tiles 50. Each game tile 50 includes 3 playing card symbols 58 that are selected from a predefined set of playing card symbols 58. The predefined set of playing card symbols 58 includes playing card symbols 58 having card suits including spades, diamonds, clubs, and hearts and card ranks including Ace, King, Queen, and Jack, Ten and Nine. Moreover, each game tile 50 includes two playing card symbols 58 having the same suit. In addition, each game tile 50 includes a unique combination of playing card symbols 58.

In one embodiment, the game tile generation unit 36 may randomly select one or more playing card symbols 58 from a predefined set of playing card symbols to form a game tile 50 and/or a playing card. In addition, the game tile generation unit 36 may randomly select one or more game tiles 50 from the game tile list 42 to form a game tile deck 52 for use in a game and/or select one or more playing cards to form a deck of playing cards (shown in FIGS. 14 and 15).

In the illustrated embodiment, the game unit 38 conducts the poker-type game 46 including dealing one or more player game tiles 60 to each player from the game tile deck 52, dealing a community hand 56 including one or more community game tiles 62 being dealt from the game tile deck 52, determining a player hand 54 associated with each player including each corresponding player game tile 60 and the community hand 56, and determining an outcome of the game as a function of each player hand 54. In one embodiment, the game unit 38 determines a value of each player hand 54 as a function of the playing card symbols 58 associated with each game tile 50 being included in the player hand 54, and determines an outcome of the game as a function of each player hand value. In another embodiment, the system controller 12 may determine a value of each player hand 54 as a function of a predefined number of playing card symbols 58 associated with each game tile 50 included in the player hand 54.

For example, in one embodiment, each game tile 50 may include 3 playing card symbols 58. The system controller 12 may distribute one player game tile 60 to each of the players and distribute a community hand 56 including a first community tile 64 and a second community tile 66. The system controller 12 may also determine each player hand 54 to include 3 game tiles 50 being associated with 9 playing card symbols 58 including the corresponding player game tile 60, the first community tile 64 and the second community tile 66. Moreover, the system controller 12 may also determine the value of a corresponding player hand 54 as a function of 6 of the 9 playing card symbols 58 included in the corresponding player hand 54.

Figure 2:
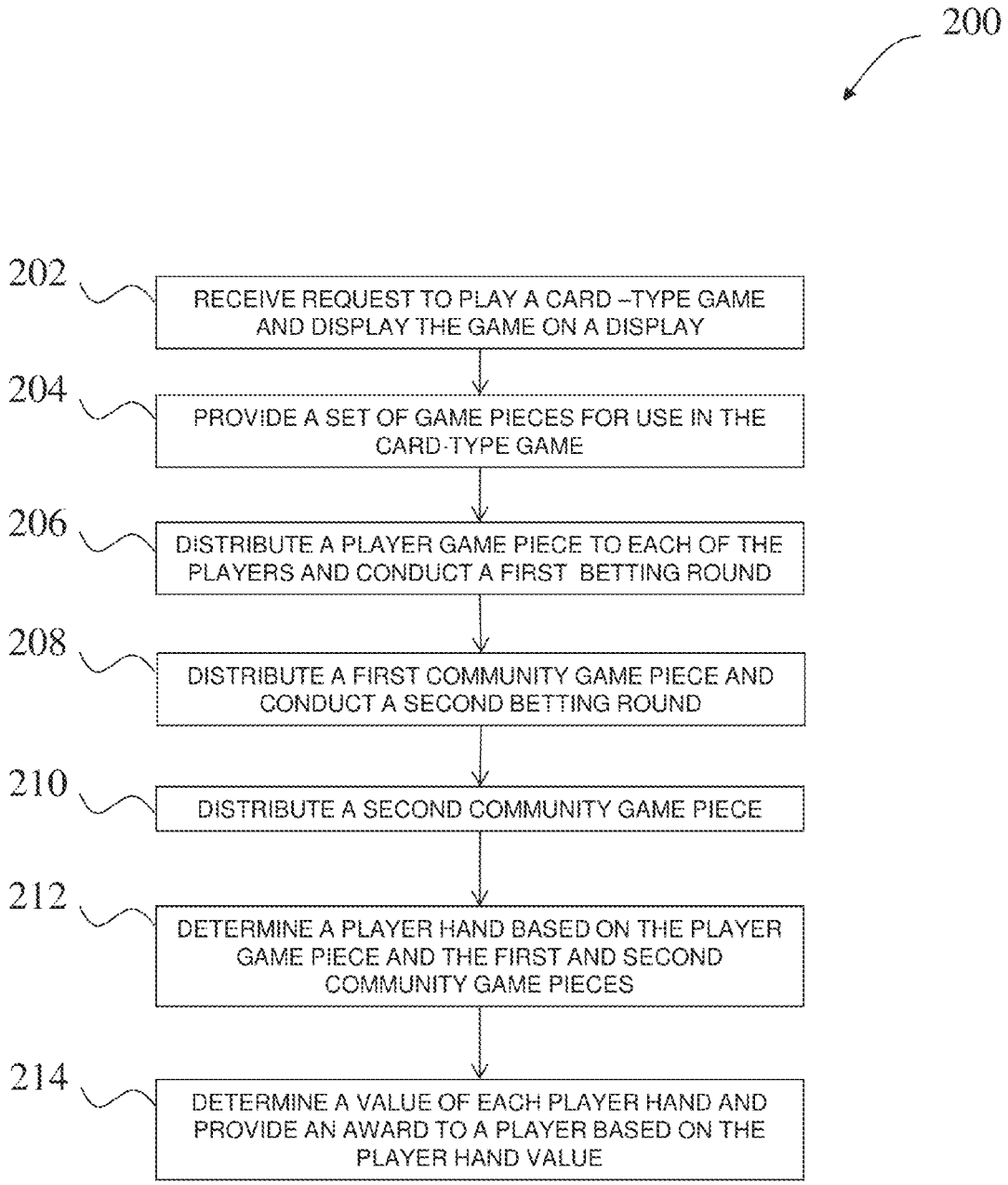
FIG. 2 is a flowchart of a method that may be used with the system shown in FIG. 1 for allowing a player to play a card-type game, according to an embodiment of the invention.

FIG. 2 is a flowchart of a method 200 that may be used with the system 10 for allowing a player to play a poker-type game 46 using the game tiles 50. Each method step may be performed independently of, or in combination with, other method steps. Portions of the method 200 may be performed by any one of, or any combination of, the components of the system 10. FIGS. 3-6, 9-12, and 37 are exemplary entertaining graphical displays of the poker-type game 46 that may be played with the system 10. FIGS. 7 and 13 are illustrations of a set of game tiles 52 that may be used with the method 200.

In the illustrated embodiment, in the method step 202, the system controller 12 receives a request from a player to play the poker-type game 46 from a user computing device 14 and displays the game 46 on the display device 20 for play by the player. In one embodiment, the player may submit the request by accessing a website and/or a mobile website via the Internet and/or the cellular network.

In method step 202, the system controller 12 may also displays a game screen 48 (shown in FIGS. 3-6 and 9-12) including the game 46 in response to the request received from the player via the user computing device 14. In the illustrated embodiment, the system controller 12 displays the poker-type game 46.

In method step 204, the system controller 12 provides a set of game tiles 50 for use in the poker-type game 46. In one embodiment, the system controller 12 may select one or more game tiles 50 to be included in a game tile deck 52 that is used with the poker-type game 46. Moreover, the system controller 12 may determine a game rule being associated with a player selected game and select a corresponding game tile deck 52 including game tiles 50 selected from the game tile list 42 as function of the associated game rule and/or player selected game. For example, in one embodiment, upon selecting a game including game rules similar to Texas Hold'em, the system controller 12 may select a game tile deck 52 including a predefined set of game tiles 50 based on the player selected Texas Hold'em type game. Moreover, upon selecting a game including game rules similar to a "No Peek" card game (shown in FIG. 8), the system controller 12 may selected a game tile deck 52 including different game tiles 50 than those used for the Texas Hold'em type game. Many variations of game rules associated with card-type games fall within the scope of the present invention.

Figure 3:
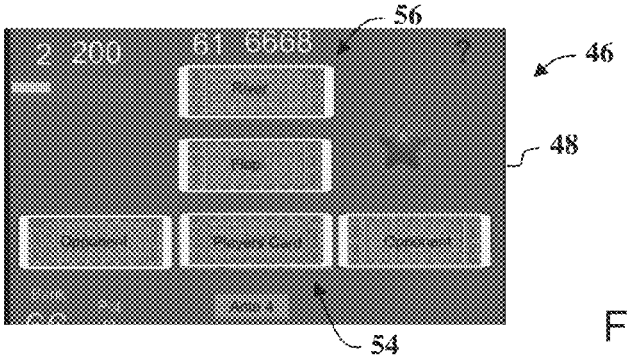
FIGS. 3-6 are exemplary entertaining graphical displays of a card-type game that may be used with the method shown in FIG. 2, according to an embodiment of the present invention.
Figure 9:
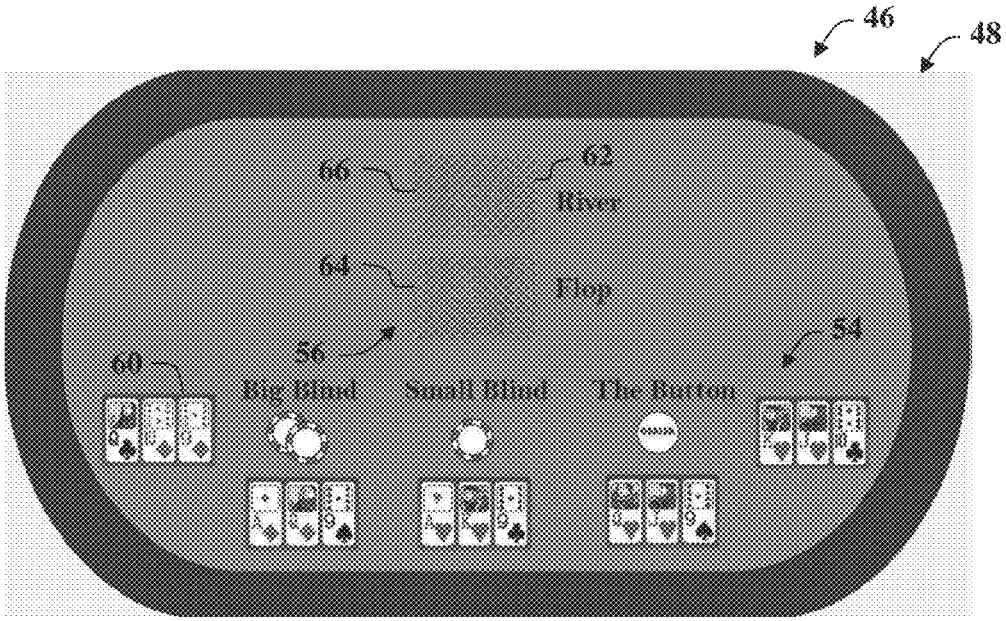
FIGS. 9-12 are exemplary entertaining graphical displays of a card-type game that may be used with the method shown in FIG. 2, according to an embodiment of the present invention.

In method step 206, the system controller 12 initiates a first dealing cycle of the game 46 including distributing one or more player game tiles 60 to each of the plurality of players from the game tile deck 52 (shown in FIGS. 3 and 9). Each game tile 50 includes a plurality of playing card symbols 58 being selected from a predefined set of playing card symbols 58. In addition, the system controller 12 may conduct a first betting round after each player game tile 60 has been distributed to allow players to place wagers on the game outcome.

Figure 4:
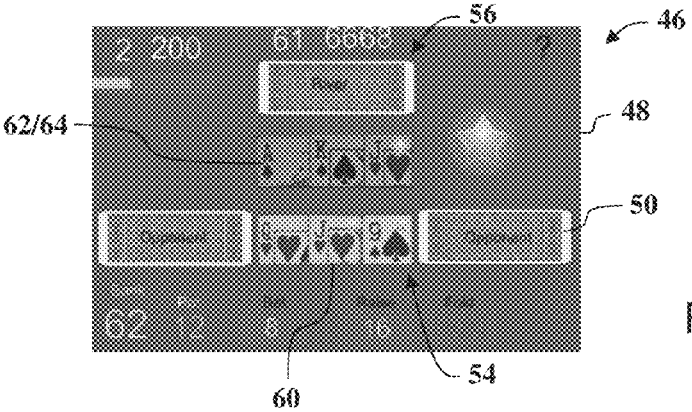
Figure 10:
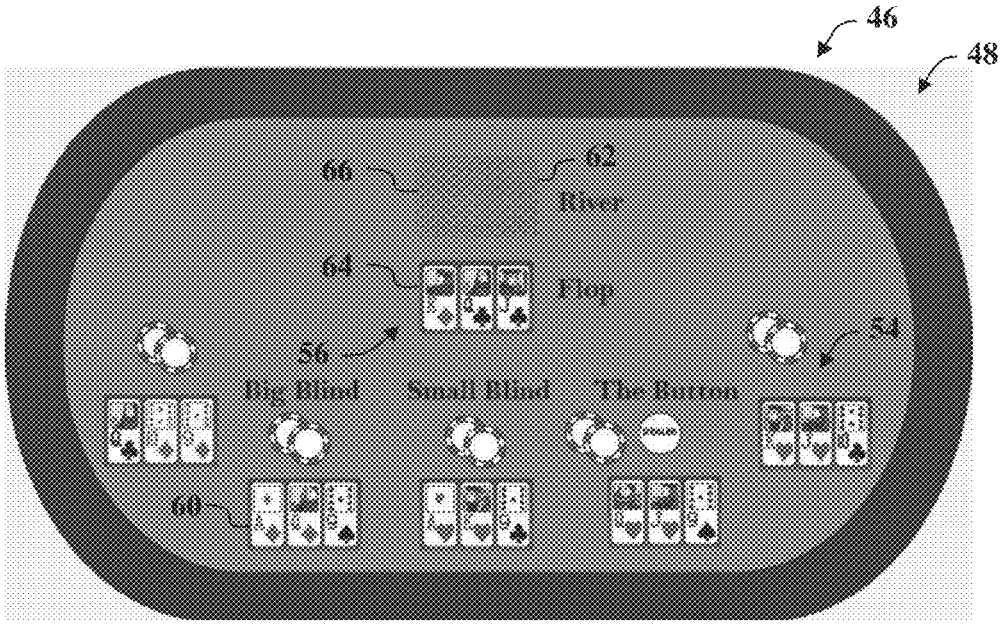

In method step 208, the system controller 12 conducts a first community deal cycle including distributing a first community tile 64, e.g. a "flop" game tile from the game tile deck 52 and displays the first community tile 64 on the game screen 48 (shown in FIGS. 4 and 10). The system controller 12 may also conduct a second betting round and allow each player to place an additional wager on the outcome of the game.

Figure 5:
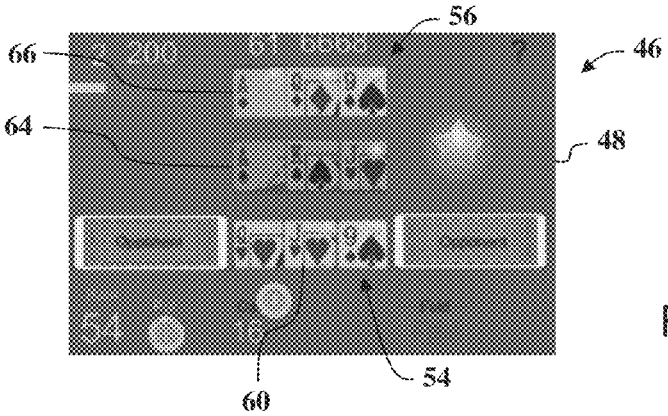
Figure 11:
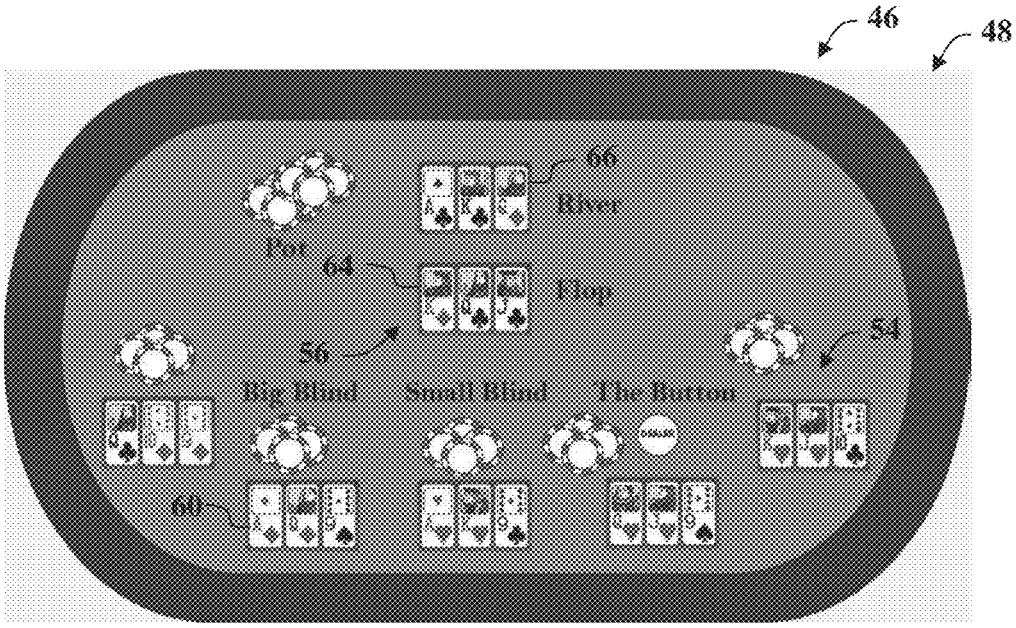

In method step 210, the system controller 12 conducts a second community deal cycle including distributing a second community tile 66, e.g. a "river" game tile from the game tile deck 52 and displays the second community tile 66 on the game screen 48 (shown in FIGS. 5 and 11). The system controller 12 may also conduct a final betting round and allow each player to place an additional wager on the outcome of the game.

Figure 6:
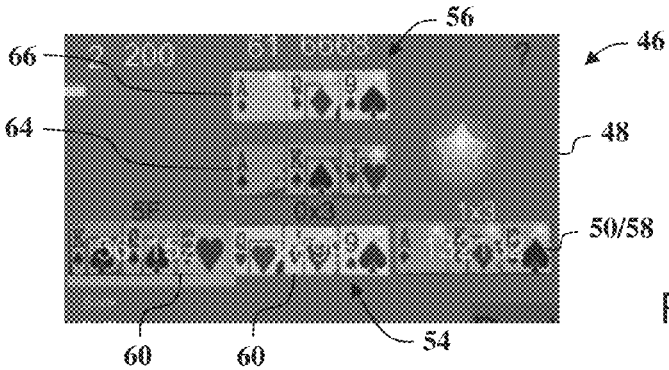
Figure 7:
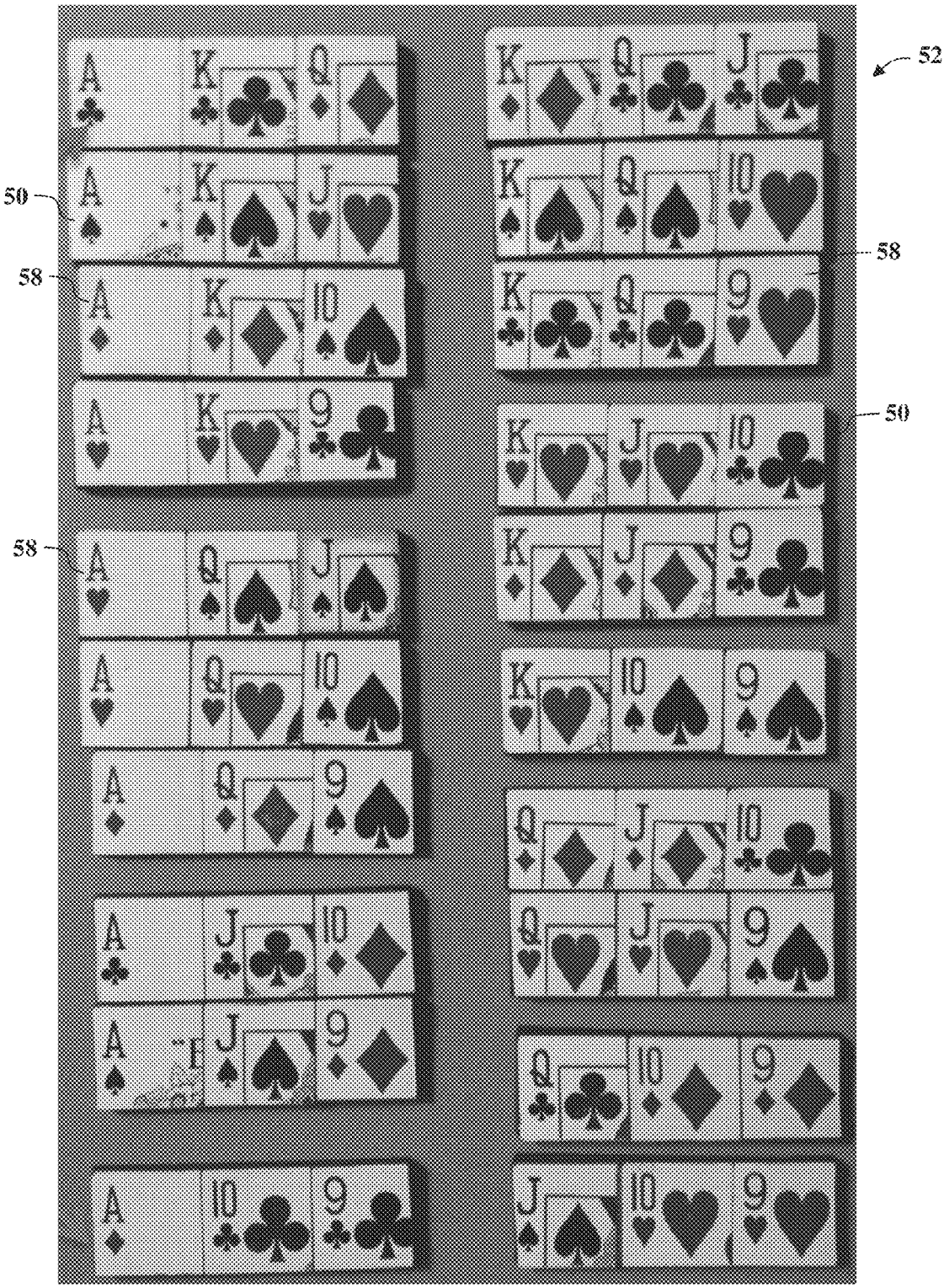
FIG. 7 is an illustration of a set of game tiles that may be used with the method shown in FIG. 2, according to an embodiment of the present invention.
Figure 12:
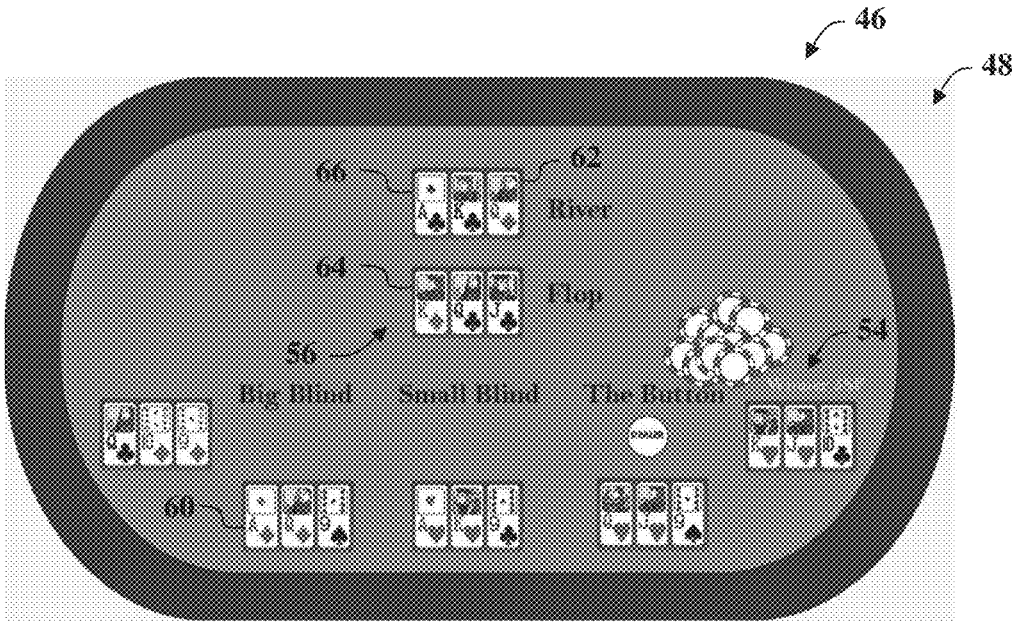
Figure 13:
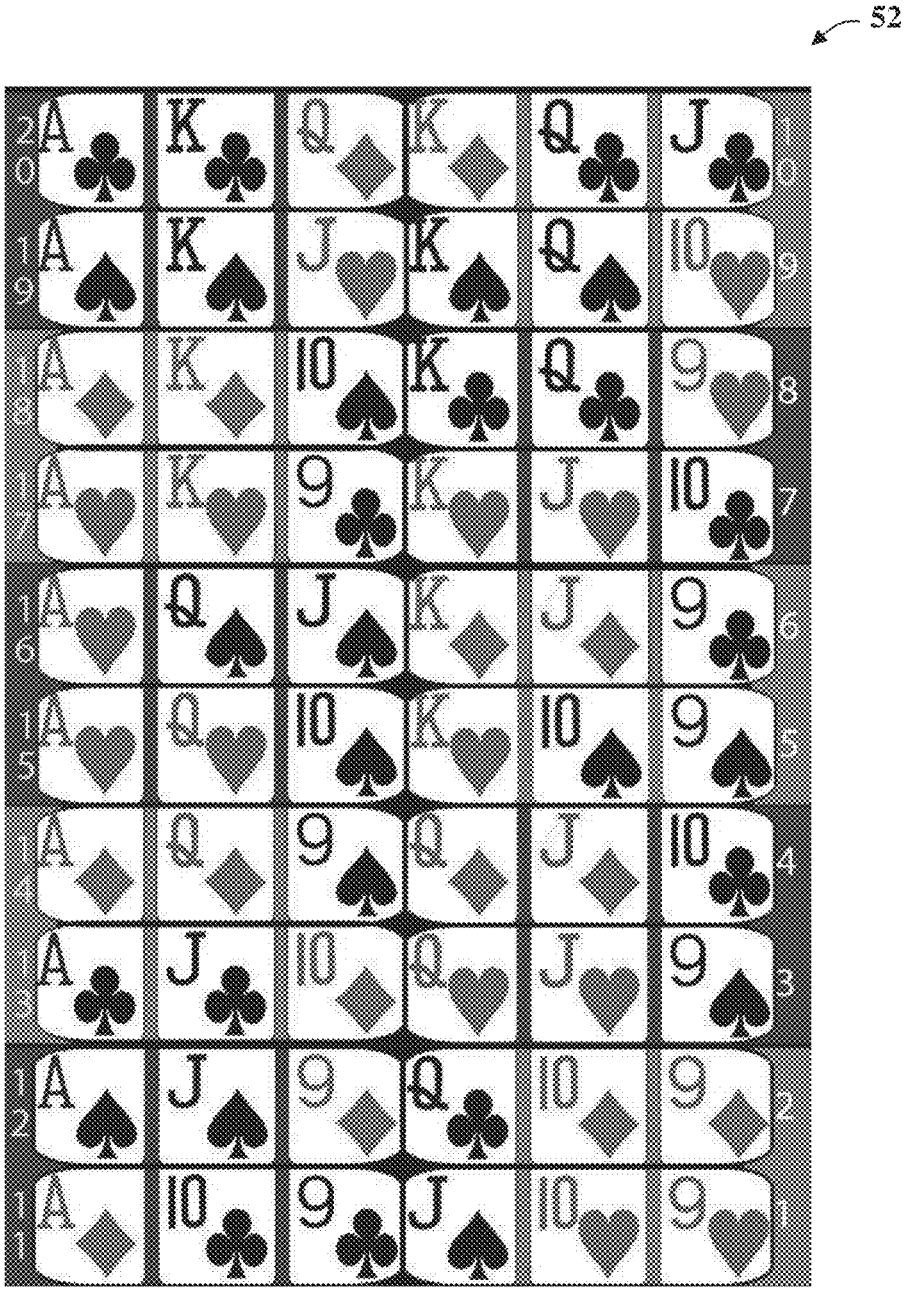
FIG. 13 is an illustration of a set of game tiles that may be used with the method shown in FIG. 2, according to an embodiment of the present invention.

In method step 212, the system controller 12 reveals each of the player game tiles 60 and determines a player hand 54 being associated with each player as a function of the corresponding player game tile 60 and the first and second community game tiles 64 and 66 (shown in FIGS. 6 and 12). In the illustrated embodiment, each player hand 54 includes a predefined number of playing card symbols 58 being displayed with each game tile 50 associated with the player including the corresponding player game tile 60 and the first and second community game tiles 64 and 66. For example, in one embodiment, each game tile 50 may display 3 playing card symbols 58 and the player hand 54 includes 2 playing card symbols 58 from each of the corresponding game tiles 50 associated with the player hand 54. In another embodiment, the player hand 54 may include each of playing card symbols 58 displayed in the corresponding game tiles 50 associated with the player hand 54.

In method step 214, the system controller 12 determines a value of each player hand 54 as function of the associated playing card symbols 58 being included in the player hand 54, determines an outcome of the game as a function of the value of each player hand 54, and provides an award to one or more players as a function of the game outcome. In addition, the system controller 12 may provide an award to at least one of the players as a function of the received wagers and the outcome.

Figure 8:
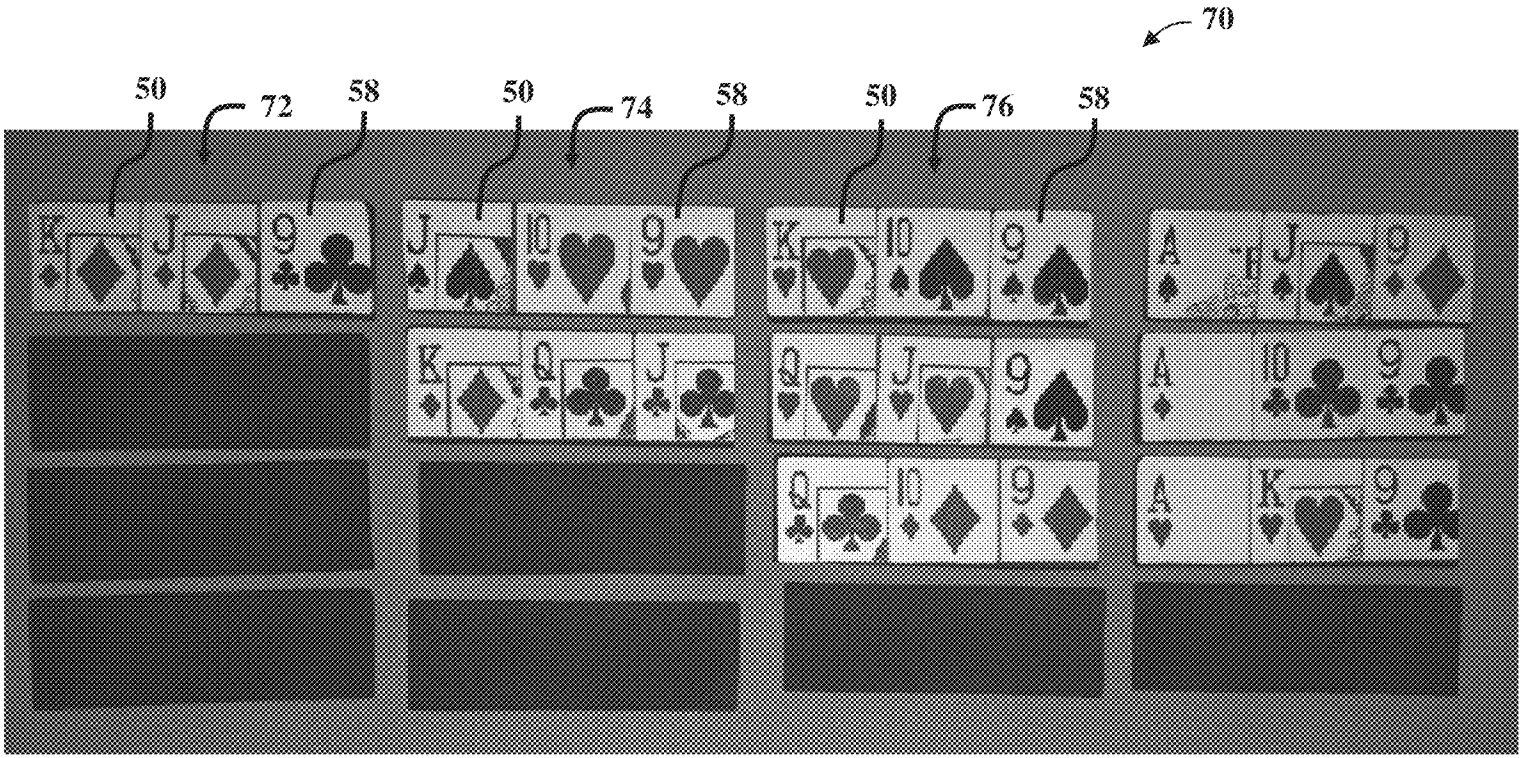
FIG. 8 is a graphical display of another card-type game that may be used with the system shown in FIG. 1, according to an embodiment of the present invention.

FIG. 8 is a graphical display of a "No Peek" card-type game 70 that may be played with the system 10. In the illustrated embodiment, the game unit 38 distributes a player hand 54 to each of the participating players. Each player hand 54 includes a plurality of game tiles 50. In one embodiment, each player hand 54 is dealt from a deck of randomly ordered game tiles 50. In another embodiment, the game unit 38 randomly selects a game tile 50 from a predefined set of game tiles 50 and distributes the selected game tile 50 to a corresponding player hand 54. In the illustrated embodiment, at the start of the game, the playing card symbols 58 associated with each game tile 50 is not displayed so that the players are not aware of the playing card symbols 58 included in each player hand 54.

During play of the game 70, the game unit 38 reveals the playing card symbols 58 displayed in a game tile 50 included in a first player hand 72 and determines a value of the first player hand 72 based on the displayed playing card symbols 58 displayed in the associated game tile 50. After each game tile 50 has been revealed, the system controller 12 may allow each player to place one or more wagers on the game outcome. The game unit 38 then reveals the playing card symbols 58 displayed in a game tile 50 of a second player hand 74 and determines if the value of the second player hand 74 is greater than the first player hand 72. If the value of the second player hand 74 is less than or equal to the first player hand 72, the game unit 38 reveals another game tile 50 included in the second player hand 74. If the second player hand 74 is greater than the first player hand 72, the game unit 38 reveals the playing card symbols 58 included in a game tile 50 included in a third player hand 76 and determines if the value of the third player hand 76 is greater than the value of the second player hand 74. Play continues in this manner until each game tile 50 in each player hand 54 has been revealed and a winning player hand has been determined.

Figure 14:
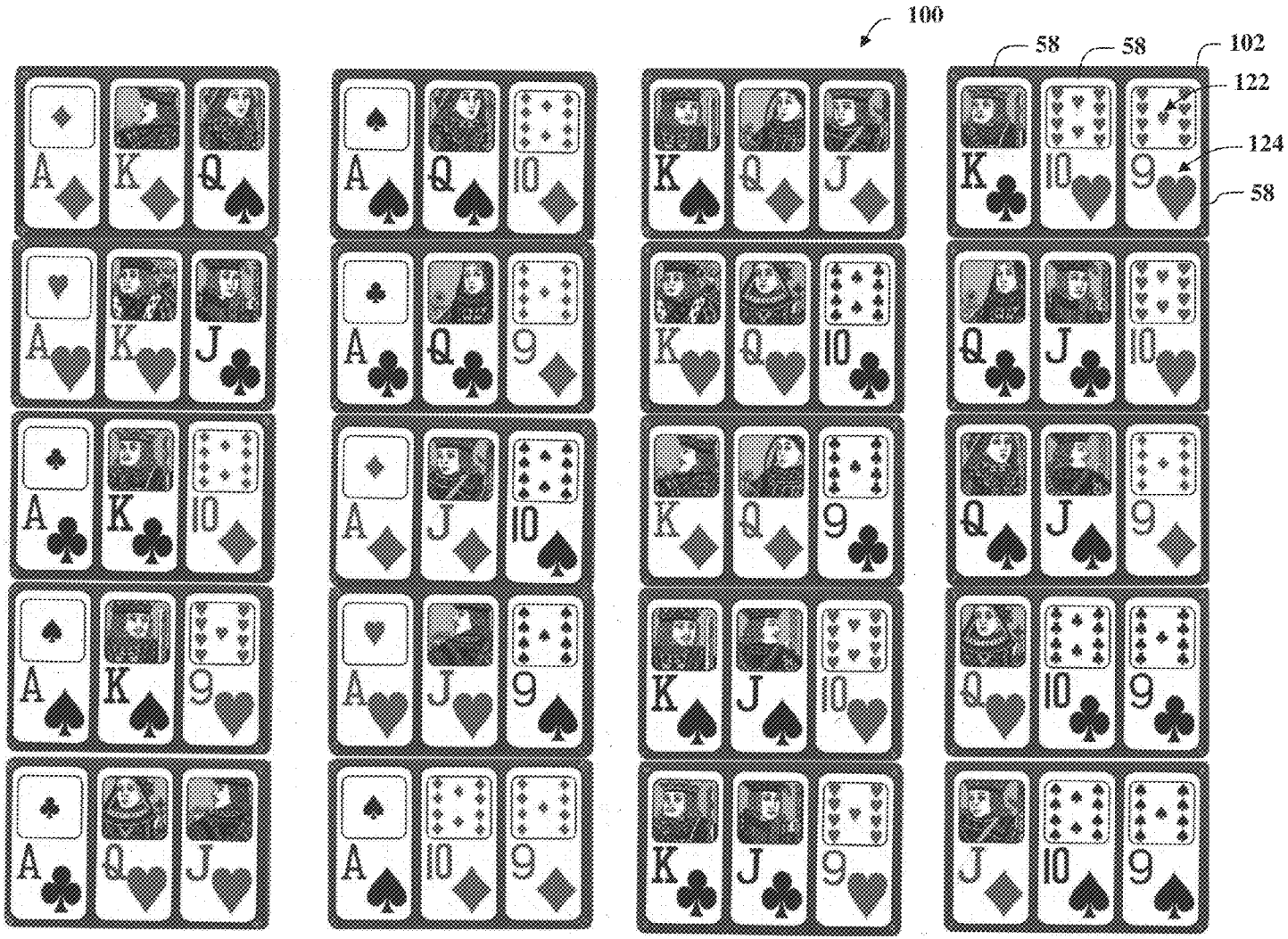
FIG. 14 is an illustration of a deck of playing cards that may be used with the method shown in FIG. 2, according to an embodiment of the present invention.
Figure 15:
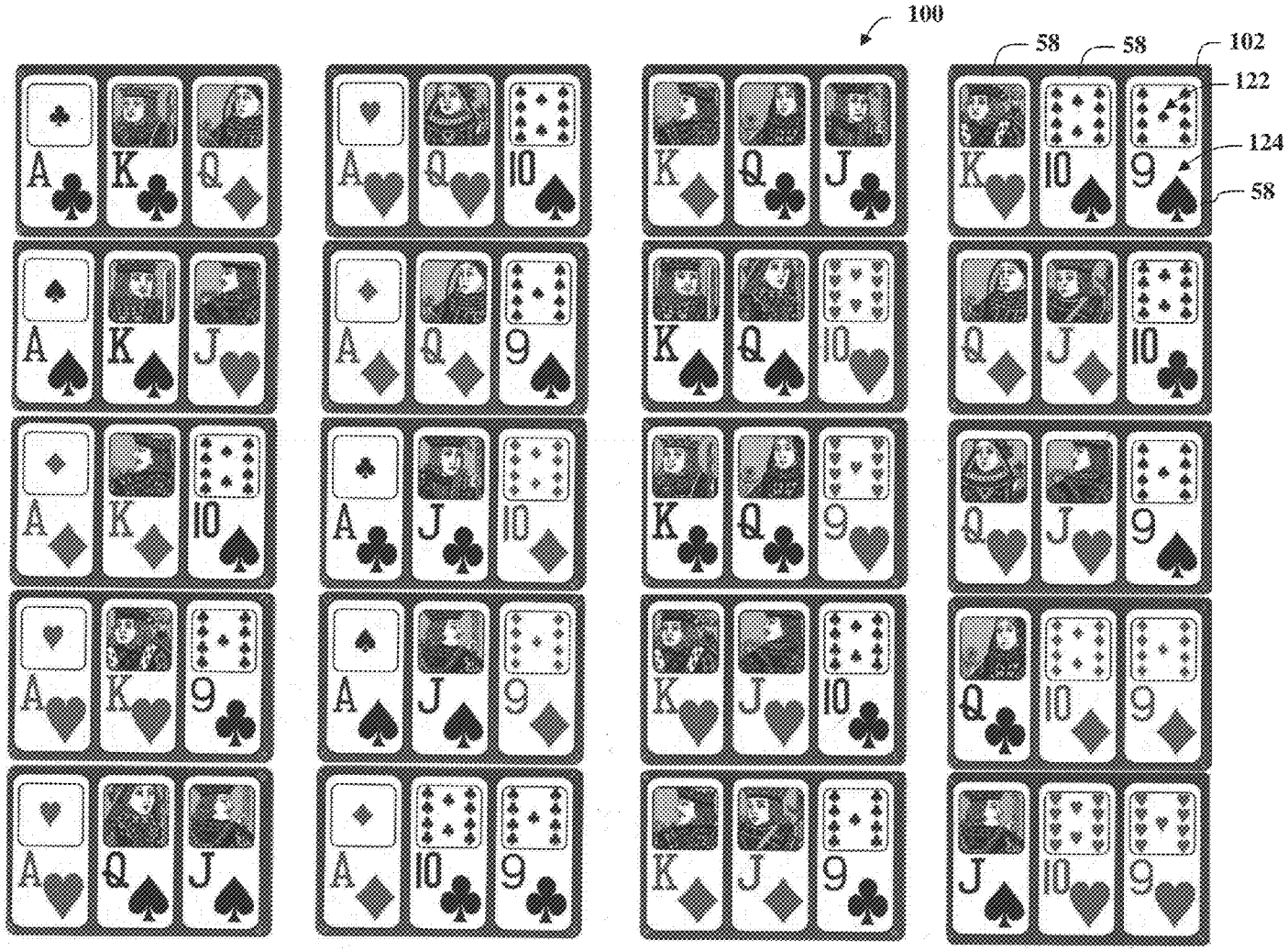
FIG. 15 is another illustration of a deck of playing cards that may be used with the method shown in FIG. 2, according to an embodiment of the present invention.
Figure 16:
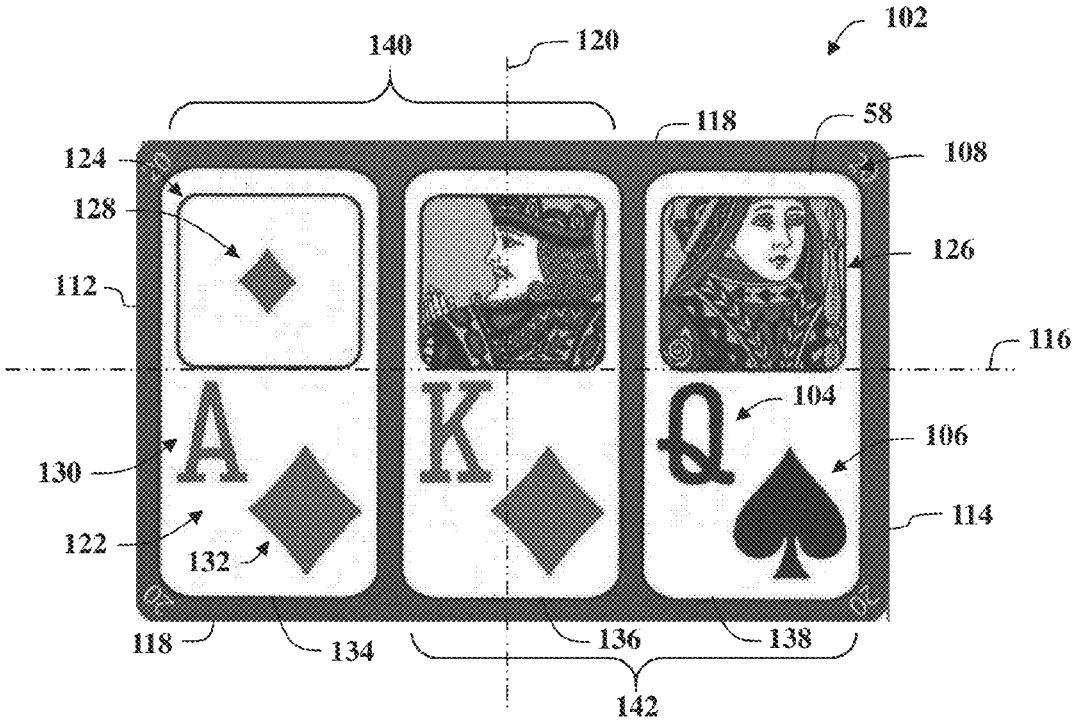
FIGS. 16 and 17 are illustrations of a playing card that may be used with the deck of playing cards shown in FIGS. 14 and 15, according to an embodiment of the present invention.
Figure 17:
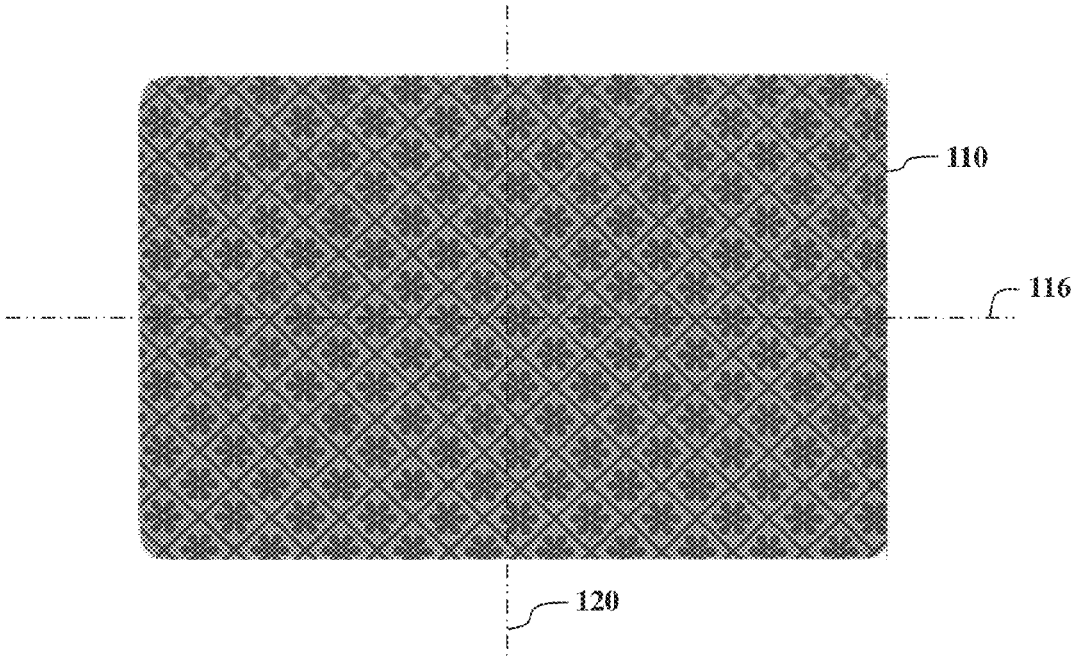

FIGS. 14 and 15 are illustrations of a deck 100 of playing cards 102 that may used for playing card-type games. FIGS. 16 and 17 are illustrations of a playing card 102 that may be used with the deck 100 of playing cards 102. In one embodiment, the deck 100 of playing cards 102 may be virtual cards that may be used by the system controller 12 during play of the game 46 (shown in FIGS. 9-12 and 37). In another embodiment, the deck 100 of playing cards 102 may include a plurality of physical playing cards that may be used by a live dealer.

In the illustrated embodiment, the deck 100 includes a plurality of playing cards 102. Each playing card 102 includes a plurality of card symbols 58 that are selected from a set of card symbols 58. For example, the set of card symbols may include and Ace, a plurality of face cards (K, Q, J) and a plurality of number cards (10, 9, 8, 7, 6, 5, 4, 3, 2). Each card symbols 58 includes an associated card rank 104 and an associated card suit 106. In the illustrated embodiment, the deck 100 of playing cards 102 include playing card symbols 58 having card suits 106 including Diamonds, Hearts, Spades, and Clubs. In addition, the deck 100 of playing cards 102 includes playing card symbols 58 having ranks selected from a predetermined list of ranks. In one embodiment, the deck 100 includes playing card symbols 58 that represent a predetermined number of consecutive card ranks. For example, as shown in FIG. 14, the deck 100 includes playing card symbols 58 representing six consecutive rank values selected from a group including Ace, King, Queen, Jack, Ten, and Nine. In another embodiment, the card symbols 58 may include rank values selected from a group including Jack, Ten, Nine, Eight, Seven, and Six and/or any suitable group of consecutive rank values. Moreover, in another embodiment, the card symbols 58 may include rank values including non-consecutive rank values and/or any suitable number of rank values.

Referring to FIGS. 16 and 17, in the illustrated embodiment, each playing card 102 includes a front side 108 and an opposite back side 110. The front and back sides 108 and 110 extend between a front edge 112 and a rear edge 114 along a longitudinal axis 116, and between opposing side edges 118 along a transverse axis 120 that is perpendicular to the longitudinal axis 116. The playing card 102 includes a plurality of card symbols 58 that are spaced along the longitudinal axis 116 between the front edge 112 and the rear edge 114. Each playing card symbol 58 includes a summary image 122 and a detailed image 124. The detailed image 124 and the summary image 122 are spaced along the transverse axis and oriented along the same direction. In the illustrated embodiment, the summary image 122 and the detailed image 124 each include images and symbols that are indicative of the rank 104 and suit 106 of the corresponding playing card symbol 58.

The detailed image 124 may include a pip status associated with the playing card symbol 58 including a face image 126 that is indicative of the associated face card or a pip image 128 that is indicative of the associated number card. For example, the number and type of pips that are displayed in the detailed image 124 represents the rank 104 and suit 106 of the number card. Similarly, the face image 126 represents the rank 104 and suit 106 of the face card. The summary image 122 includes a rank image 130 indicative of the corresponding rank 104 and a suit image 132 indicative of the corresponding suit 106. Each playing card symbol 58 has a card value that is determined based on the combination of the corresponding rank 104 and suit 106 of the playing card symbol 58. For example, as shown in FIG. 16, the playing card 102 includes a plurality of playing card symbols 58 including the ace of diamonds 134, the king of diamonds 136, and the queen of spades 138.

In the illustrated embodiment, each playing card 102 included in the deck of playing cards 102 includes at least three card symbols 58. In addition, each of the playing card symbols 58 includes a different card value. For example, as shown in FIG. 14, each card symbol 58 included in a corresponding playing card 102 has a different rank/suit combination. In one embodiment, at least one playing card 102 included in the deck 100 of playing cards 102 includes a first pair 140 of card symbols having the same suit 106. For example, as shown in FIG. 16, the illustrated playing card 102 includes a first pair 140 including the ace of diamonds 134 and the king of diamonds 136. Each playing card 102 may also include a second pair 142 of card symbols 58 that have different card suits 106. For example, as shown in FIG. 16, the playing card 102 includes the second pair 142 including the king of diamonds 136 and the queen of spades 138. In addition, in the illustrated embodiment, each playing card 102 includes card symbols 58 having different ranks 104.

Referring to FIGS. 14 and 15, in one embodiment, the deck 100 of playing cards 102 includes at least twenty playing cards 102 and at least sixty card symbols 58, with each playing card 102 including two different suits 106 of card symbols 58. The deck 100 also includes including at least twenty-four different card values, e.g. suit and rank combinations. In the illustrated embodiment, the deck 100 includes at least fifteen card symbols 58 that have the same suit 106 and at least ten card symbols 58 that have the same rank 104. In addition, the deck 100 may include at least two playing cards 102 that have at least one card symbol 58 that is the same. In one embodiment, the deck 100 of playing cards 102 may includes a plurality of card symbols 58 including a number of first card symbols that is different than a number of second card symbols.

For example, in one embodiment, as shown in FIG. 14, the card values of the plurality of playing card symbols 58 being included in the deck 100 of playing cards 102 may be illustrated in the following Table 1.

TABLE 1

Playing Card Symbol Values

| | Suit | | | |
|---|---|---|---|---|
| Rank | Hearts | Diamonds | Clubs | Spades |
| Ace | 2 | 2 | 3 | 3 |
| King | 2 | 2 | 3 | 3 |
| Queen | 3 | 2 | 3 | 2 |
| Jack | 2 | 3 | 2 | 3 |
| Ten | 3 | 3 | 2 | 2 |
| Nine | 3 | 3 | 2 | 2 |
| TOTAL | 15 | 15 | 15 | 15 |

The first column represents the rank value the playing card symbol 58 included in the deck 100 of playing cards 102. The second, third, fourth, and fifth column represent the suit values of the playing card symbol 58. As shown in FIG. 14 and in the above illustrated table, the deck 100 of playing cards 102 shown in FIG. 14 includes 15 card symbols 58 of each suit 106 and 10 card symbols 58 of each rank 104.

The number of suited consecutive pairs of card symbols 58 included in the deck 100 of playing cards 102 shown in FIG. 14 is illustrate in the following Table 2.

TABLE 2

Number of Suited Consecutive Pair

| Suited Pairs | Total | Red | Black |
|---|---|---|---|
| AK | 4 | 2 | 2 |
| KQ | 2 | 2 | 0 |
| QJ | 2 | 0 | 2 |
| J-10 | 0 | 0 | 0 |
| 10-9 | 2 | 0 | 2 |
| Total | 10 | 4 | 6 |

The first column represents the consecutive combination of pairs included in the deck 100 shown in FIG. 14. The second, third, and forth columns represent the total number of corresponding suited consecutive pairs, the total number of "Red" (hearts and diamonds) suited consecutive pairs, and the total number of "Black" (spades and clubs) suited consecutive pairs included in the deck 100.

The card values of the playing card symbols 58 being included in the deck 100 shown in FIG. 15 may be illustrated in the following Table 3. The deck 100 shown in FIG. 15 is the inverse of the deck shown in FIG. 14.

TABLE 3

Playing Card Symbol Values

| | Suit | | | |
|---|---|---|---|---|
| Rank | Hearts | Diamonds | Clubs | Spades |
| Ace | 3 | 3 | 2 | 2 |
| King | 3 | 3 | 2 | 2 |

TABLE 3-continued

| Playing Card Symbol Values | | | | |
|---|---|---|---|---|
| | Suit | | | |
| Rank | Hearts | Diamonds | Clubs | Spades |
| Queen | 2 | 3 | 2 | 3 |
| Jack | 3 | 2 | 3 | 2 |
| Ten | 2 | 2 | 3 | 3 |
| Nine | 2 | 2 | 3 | 3 |
| TOTAL | 15 | 15 | 15 | 15 |

In the illustrated embodiment, the deck 100 of playing cards 102 includes 20 playing cards 102, with 3 card symbols 58 on each playing card equal to 60 total card values (20×3). The deck 100 includes 6 total Ranks (9, 10, J, Q, K, A) and 4 total Suits (Club's, Diamonds, Spades, Heart.). Each of the 6 Ranks is represented 10 times, e.g. 10 of each Rank (9's, 10's, J's, Q's, K's, A's). Each of the 4 suits is represented 15 times, e.g. 15 Hearts, 15 Spades, 15 Diamonds, 15 Clubs, twice on 5 playing cards and once on 5 playing cards.

Every 2 Rank Combo, For example 10-9, and A-K is represented on only four playing cards with each of the other 4 Ranks making up the 3rd value on each playing card. Every possible 3 Rank possibility is represented in the deck 100, starting with A K Q, A K J, A K 10 . . . . And ending with J 10 9.

To form an inverse deck, as shown in FIG. 38, the formula is: Exchange every double ranks as follows: 1) Clubs with Diamonds; 2) Diamonds with Clubs; 3) Spades with Hearts; and 4) Hearts with Spades; and Exchange every Single rank as follows: 1) Clubs with Hearts; 2) Hearts with Clubs; 3) Diamonds with Spades; and 4) Spades with Diamonds.

FIGS. 19-27 are illustrations of player hands that may be formed using the game tiles shown in FIGS. 7 and 13 and the deck of the playing cards shown in FIGS. 16 and 17, according to an embodiment of the present invention. In the illustrated embodiment, the deck 100 of playing cards 102 may be used to play a poker-type card game. For example, in one embodiment, the system 10 may use the deck 100 of playing cards 102 to play the poker-type game 46. In another embodiment, the game 46 may be played with a live dealer distributing physical playing cards 102 from the deck 100 of playing cards 102. In one embodiment, winning hand values may be determined as illustrated in a hand value table 144 shown in FIG. 18.

In one embodiment, referring to FIG. 9-12, the system 10 and/or live dealer may receive a wager from participating players and distributes a player card 60 to each of the participating players. Each player card 60 being selected from the deck 100 of playing cards 102. A community card 62 is distributed from the deck 100 of playing cards 102, and the value of each player hand is determined as a function of the card symbols 58 being displayed with the community card 62 and the card symbols 58 being displayed with the corresponding player card 60. The system 10 and/or dealer determines a winning player hand as a function of the corresponding hand value and settles each receiving wager by either awarding a payout amount to the winning player or collecting the wager.

For example, in one embodiment, each player (3 players in this case) is given 1 playing card 102 "Whole Cards" with 3 card symbols 58 on it. The community cards 62 including a "Flop" playing card 102 is dealt, and a "River" playing card 102 is dealt. All players use the 2 Community Cards (Flop and River) along with their "Whole Cards" to make the best 6 Card Poker hand.

Figure 18:
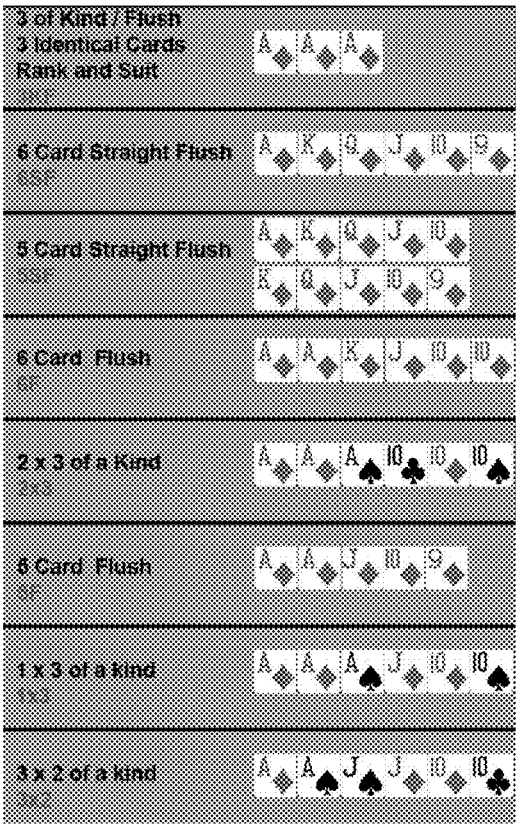
FIG. 18 is an illustration of a hand value table that may be used with the method shown in FIG. 2, according to an embodiment of the present invention.
Figure 19:
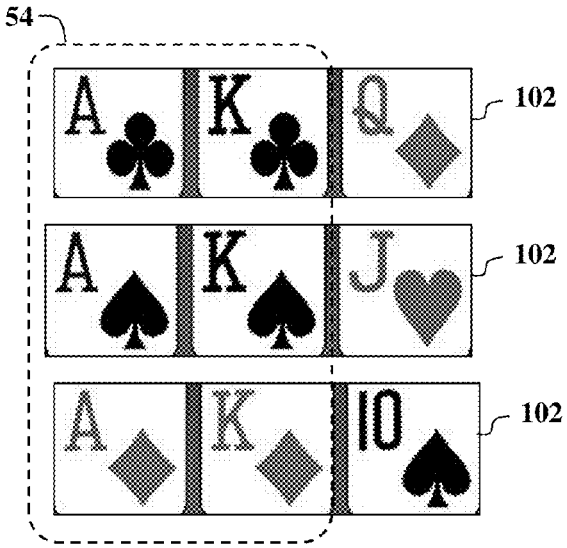
FIGS. 19-27 are illustrations of player hands that may be formed using the game tiles shown in FIGS. 7 and 13 and the deck of the playing cards shown in FIGS. 16 and 17, according to an embodiment of the present invention.
Figure 20:
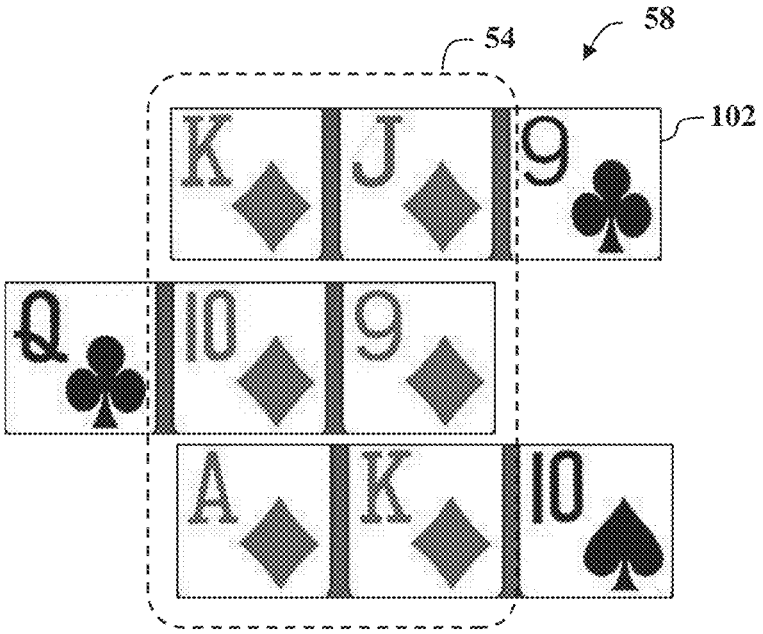
Figure 21:
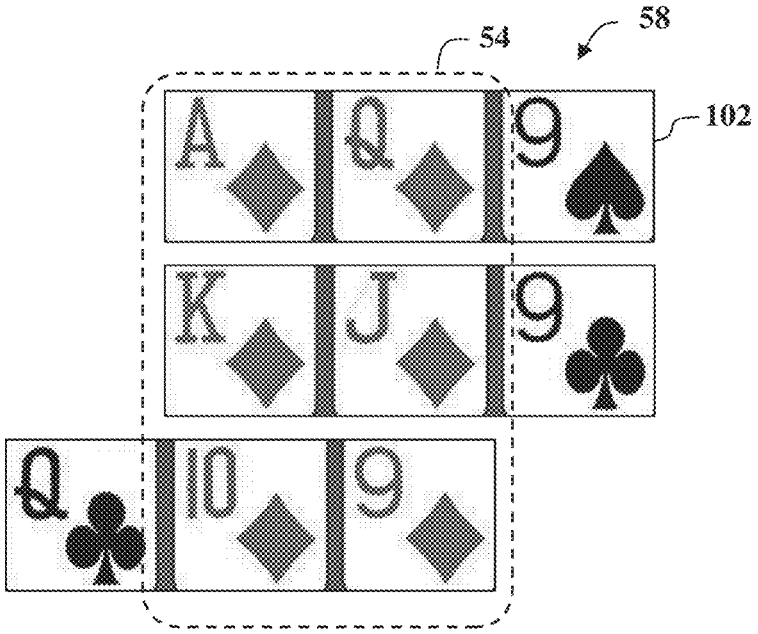

In one embodiment, the winning hand may be determined using a hand value table 144 shown in FIG. 18. For example, as shown in FIG. 19, the player hand 54 may be made up of 3 playing cards 102 used to make the best 6 Card Poker hand. FIG. 19 illustrates a player hand that includes 3 Aces and 3 Kings for a hand value of two times Trips (2×3). As shown in FIGS. 20 and 21, the playing cards 102 may be used to from a 6-card flushes and 6-card straight flush. Each Suit has 5 cards that have 2 of that Suit on them, in this case the 5 with double Diamonds are shown in FIG. 20. Since 3 playing cards are used to make a hand, any 3 of these playing cards is a 6 Card Flush (6F). FIG. 21 illustrates a 6 card Straight Flush (6SF) 9-10-J-Q-K-A of Diamonds. Each suit has only 2 ways to make a 6 card Straight Flush (6SF).

Figure 22:
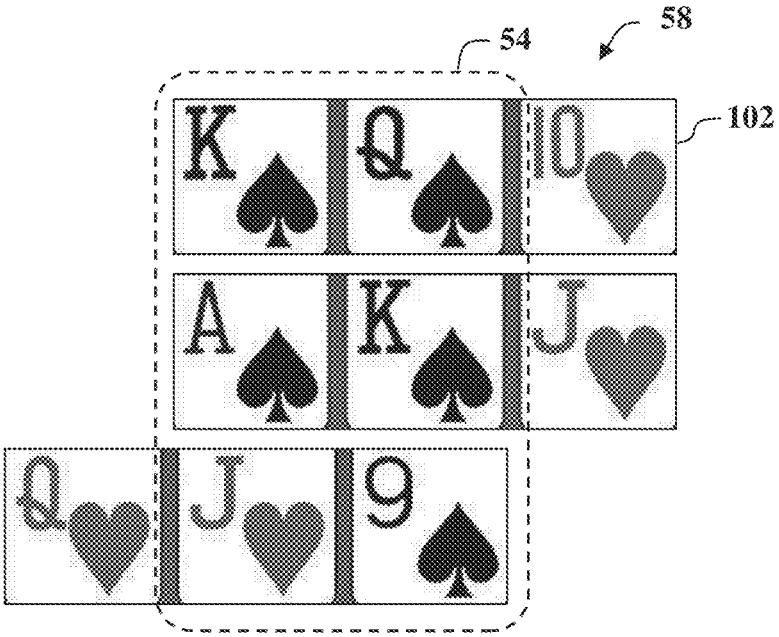
Figure 23:
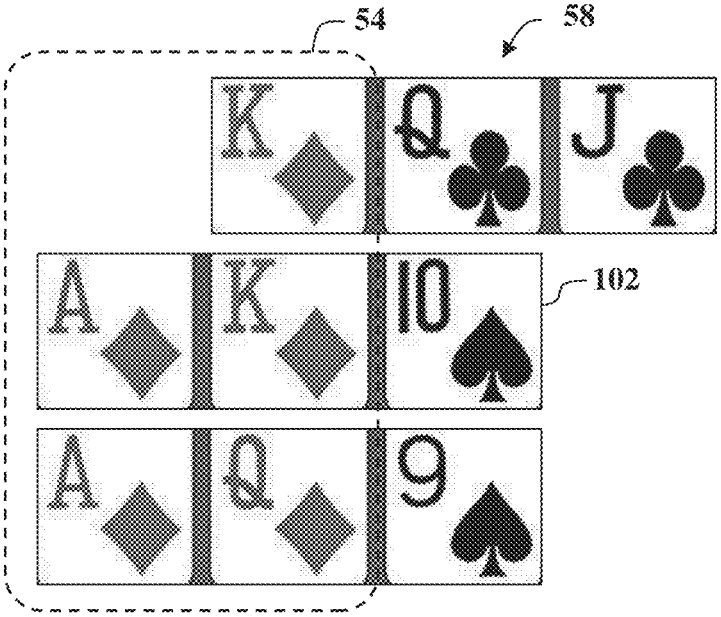
Figure 24:
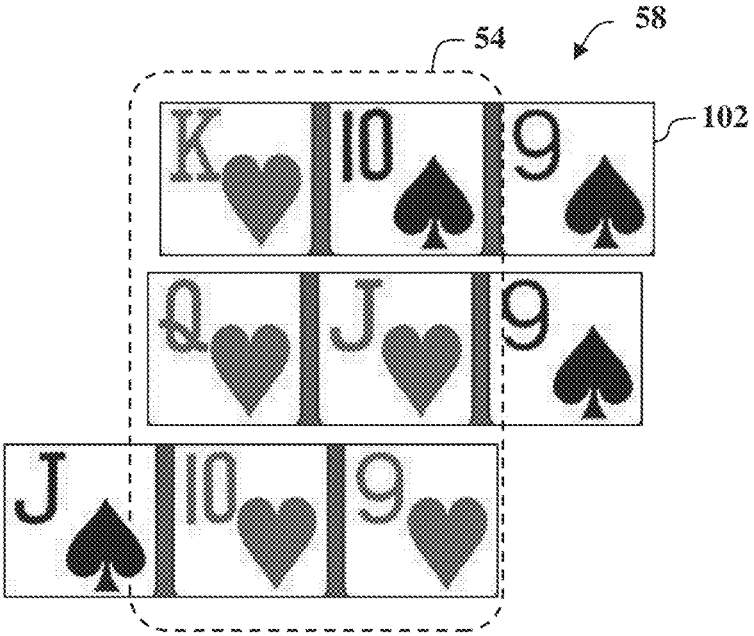
Figure 25:
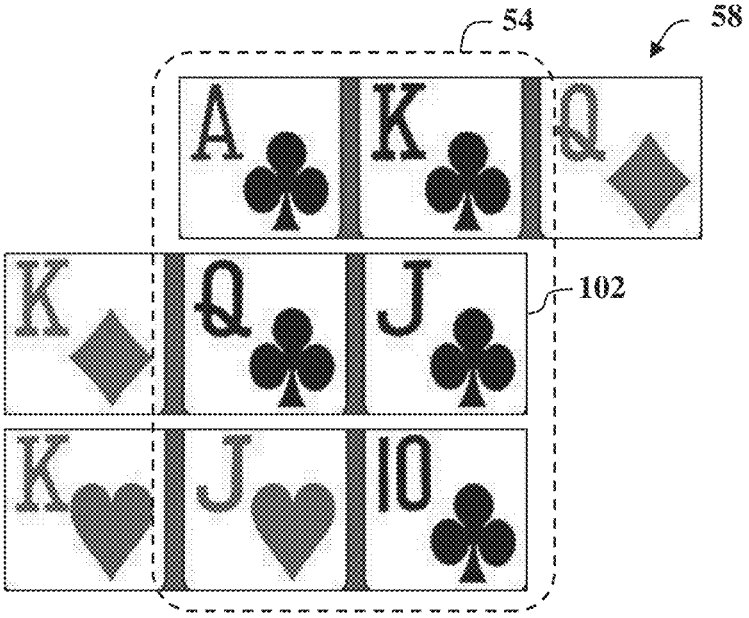
Figure 26:
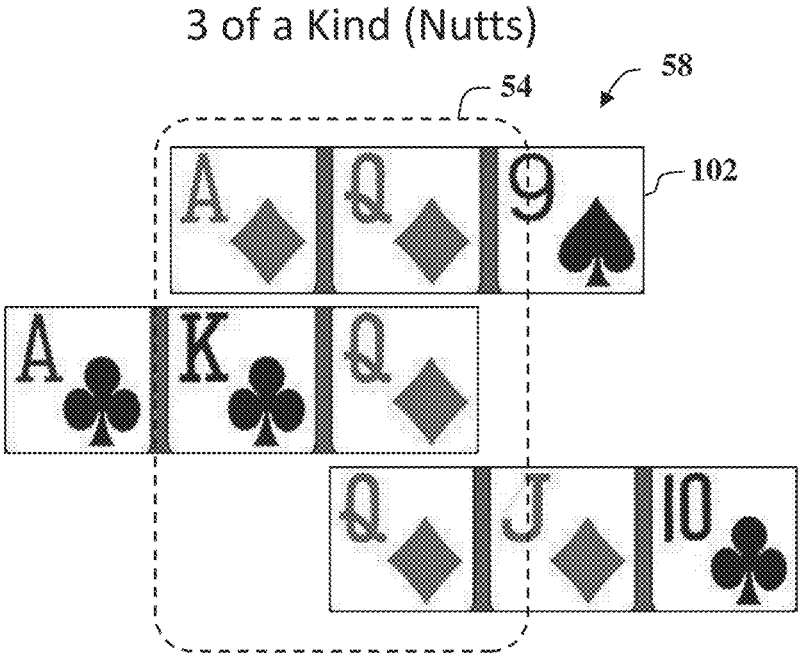
Figure 27:
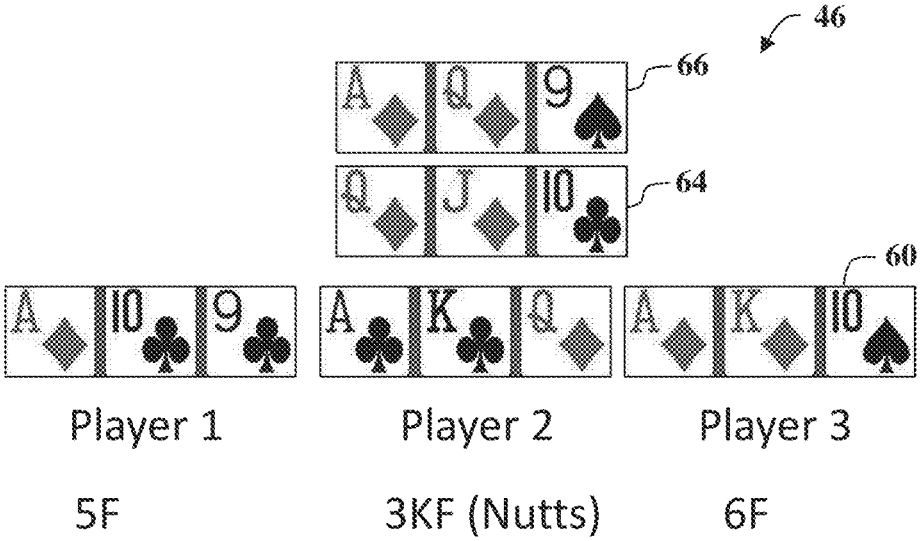

5 Card Flushes require at least two (of three) playing cards 102 to have the same double Suits. FIGS. 22 and 23 illustrate two examples of 5 Card flushes (5F) the first with Spades and the second with Diamonds. 5 Card Straight Flushes (5SF) require at least two (of three) Game pieces to have the same double Suits. FIGS. 24 and 25 illustrate two examples of 5 Card flushes (5SF) the Top with Hearts 9-10-J-Q-K and the second with Clubs 10-J-Q-K-A. Three of a Kind Flush is 3 of the identical card symbols, for example, 3 Queen of diamonds is shown in as shown in FIG. 26. In one embodiment, the deck 100 includes only three playing cards 102 that can make this hand making it the highest possible hand. For example, a 6 Card Flush (6SF) can only be made with 3 playing cards 102 also making it the Nutts. In one embodiment, it may not be possible for one player to have 3KF and another to have 6SF, so if a player has either of these hands the player has the Nutts. FIG. 27 illustrates additional hand values that may be formed with the deck 100.

In one embodiment, referring to FIGS. 9-12 illustrate a game that may be played with the Set Poker Deck™, e.g. the deck 100 of playing cards 102, is a specially designed deck of 20 cards, each card is a SET of 3 values in this case (Ace of Clubs, King of Clubs and Queen of Diamonds) they also each have a number value from 1-20. The higher the number, the stronger the card. The game may be played by 2-10 players (optimized for 5-6 players). Playing Time: 1-2 minute per hand. Equipment: A Set Poker Deck™ of cards, coins or poker chips for betting and a Dealer Button (a 50 cent piece or Dollar Coin will work for the dealer button). To begin: shuffle all 20 of the cards in the Set Poker Deck™. To Begin Each Hand. One player is chosen as the dealer. The player to his left is the Small Blind of 1 chip (Blinds are forced bets to initiate betting) and the next player moving clockwise is the Big Blind of 2 chips. Then, everyone is dealt one card from the Set Poker Deck™. Everyone should now have one card. Each player keeps their cards face values hidden from the other players. Two cards are dealt face down in the middle of the table. These are the community cards, the Flop and the River, and these 2 cards will be used along with each player's card to make their best the Six Card Poker.

For example, FIG. 9 represents the 2 community cards (Flop and River) and the bottom card is the player's. This player's Best 6 card hand is a 5-card flush of spades with a queen of hearts for a kicker.

The Play: Spread Limit Version (2-4 coins limited raise).

The Flop (2 coins): The Flop card is turned over (FIG. 10) and each player can place a value on his or her hand by adding up his or her best hand up to this point. Starting with the first person to the right of the Big Blind, each player decides if the odds are in their favor to call the Big Blind (2 coins), Raise or Fold their hand. When the betting gets back around to the Big Blind, that player will also have the option to Check, Call, Raise or Fold.

Raises and Re-raises are in multiples of the Big Blind. For example the first raise is "raise to 4" the second raise would be "Re-raise to 6" and the third and final raise allowed would be "Re-raise to 8".

The River (4 coins): The River card is turned over (FIG. 11) and each remaining player can place a final value on his or her hand by adding up his or her best hand from the two community cards combined with his or hers own card. Starting with the first person to the right of the Dealer (the Small Blind), each player decides if the odds are in their favor to Check, Bet (4), Raise or Fold their hand. When the final betting is completed then there is a showdown for the best hand.

Raises and Re-raises on the River are in multiples of twice the Big Blind (4). For example the first raise is "raise to 8" the second raise would be "Re-raise to 12" and the third and final raise allowed would be "Re-raise to 16".

The Showdown: Now that all the betting has been completed all players reveal their cards (FIG. 12). This can preferably be done all at once. However, the person who last called a bet or re-raise has the option to show last. The player with the highest hand wins the pot (e.g. the hand value table 144 shown in FIG. 18).

Play another round: The Dealer Button moves to the left (the Small Blind is now the Dealer) all the cards are shuffled and a new hand is dealt.

This version is a spread-limit game with bets of 1-10 on the first round, and 2-20 on the second. Note that in this structure there is no minimum raise (if one player raises 10, the next player can still raise 1). It is also not legal to check; you must bet (or call) at least 1, or fold.

Figure 28:
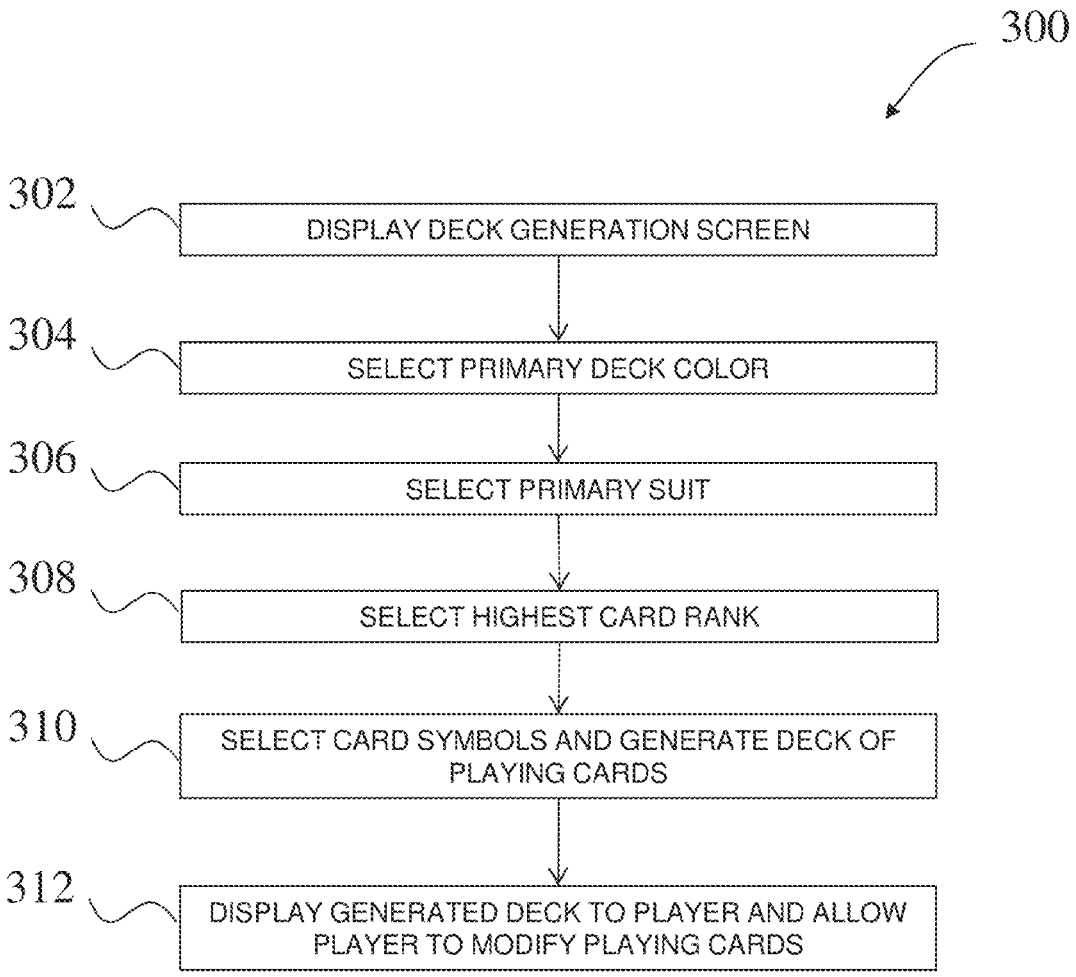
FIG. 28 is a flowchart of a method that may be used with the system shown in FIG. 1 for allowing a player to generate a deck of playing cards, according to an embodiment of the invention.
Figure 29:
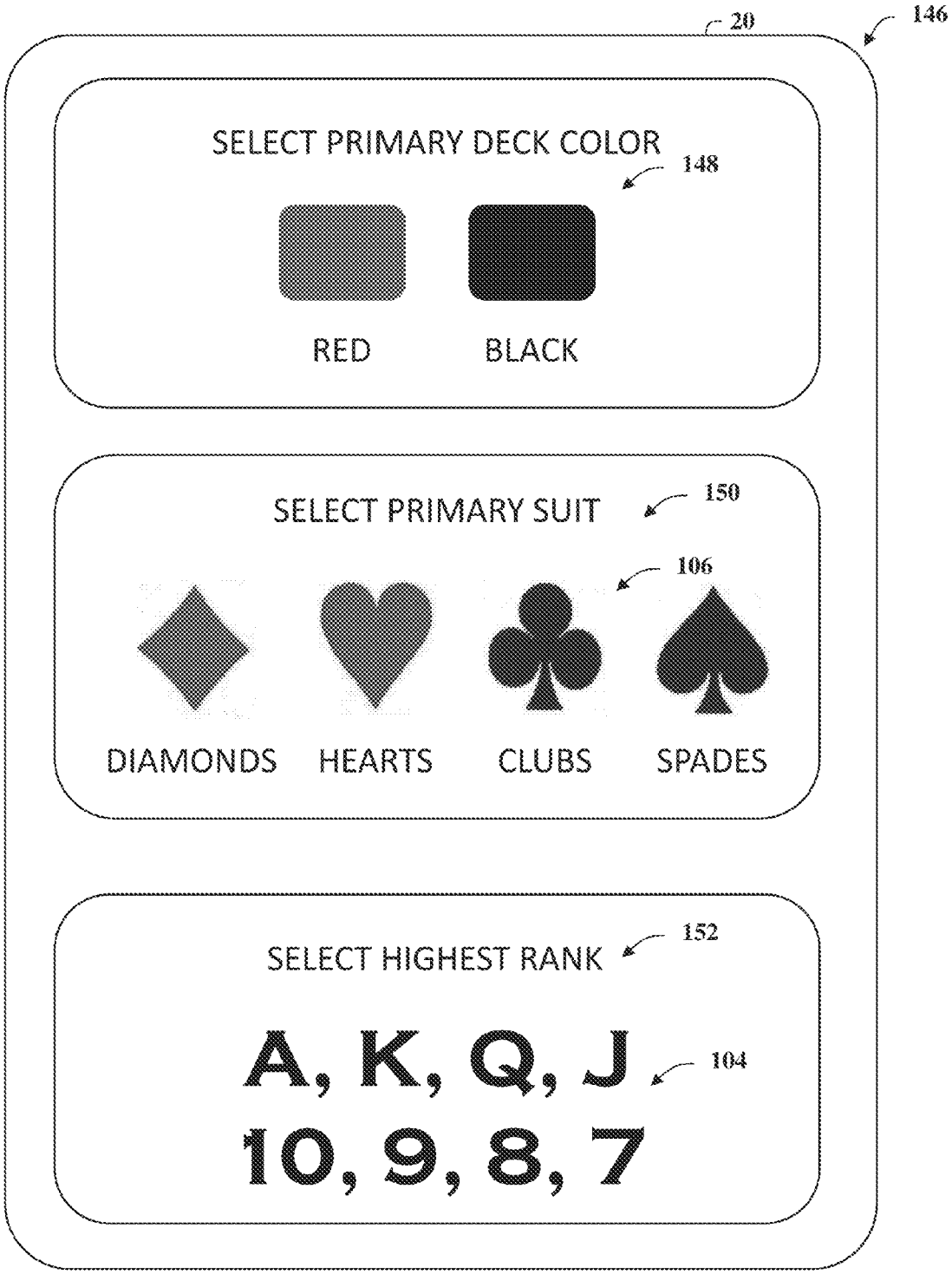
FIG. 29 is an exemplary entertaining graphical display of a deck selection screen that may be used with the method shown in FIG. 28, according to an embodiment of the present invention.

FIG. 28 is a flowchart of a method 300 that may be used with the system 10 for generating the deck 100 of playing cards 102 that may be used to play a poker-type game 46 using the game tiles 50. Each method step may be performed independently of, or in combination with, other method steps. Portions of the method 300 may be performed by any one of, or any combination of, the components of the system 10. FIG. 29 is an exemplary entertaining graphical displays of a deck selection screen 146 that may be used with the method 300.

In the illustrated embodiment, in method step 302, the system controller 12 displays the deck selection screen 146 to the player to allow the player to select one or more parameters for use in generated the deck 100 of playing cards 102.

In method step 304, the controller 12 allows the player to select a primary deck color 148. For example, as shown in FIG. 29, the controller 12 allows the player to select either "Red" or "Black" as the primary color. In method step 306, the system allows the player to select a primary suit 150 from a group including "diamonds", "hearts", "clubs", and "spades". In method step 308, the controller 12 allows the player to select a highest rank value 152 from the group including Ace, King, Queen, Jack, Ten, Nine, Eight, and Seven. In method step 310, the controller 12 selects the card symbols 58 based on the selections made by the player and generates the deck 100 as a function of the player's selections. For example, in one embodiment, upon receive a player selection of "Red", the controller 12 may generate the deck 100 to include a greater number of high-valued card symbols 58 being "red" as shown in Table 3 and/or a greater number of suited pairs, as shown in Table 2. In addition, upon receiving the player's selection of a primary suit 150, the controller may generate the deck 100 to include a greater number of high-ranked card symbols 58 having the selected suit 106, as shown in Table 3.

In method step 312, the controller 12 displays the generated deck 100 to the player and allows the player to modify one or more of the playing cards 102 being included in the deck 100. In one embodiment, the controller 12 may allow the player to adjust and/or change the combinations of card symbols 58 being displayed in each playing card.

Figure 34:
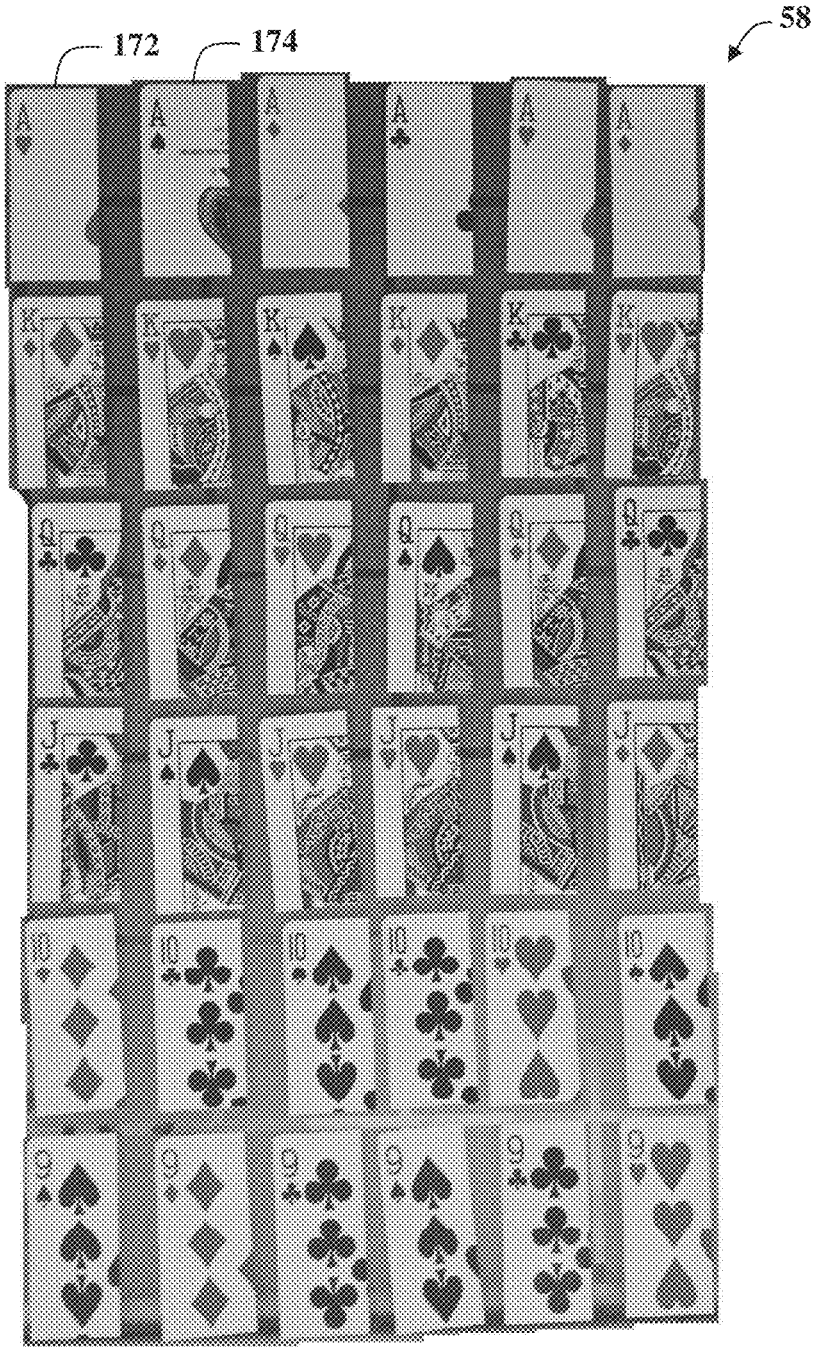
FIGS. 34 and 35 are illustrations of playing card symbols that are included in the dice shown in FIGS. 30-33.
Figure 35:
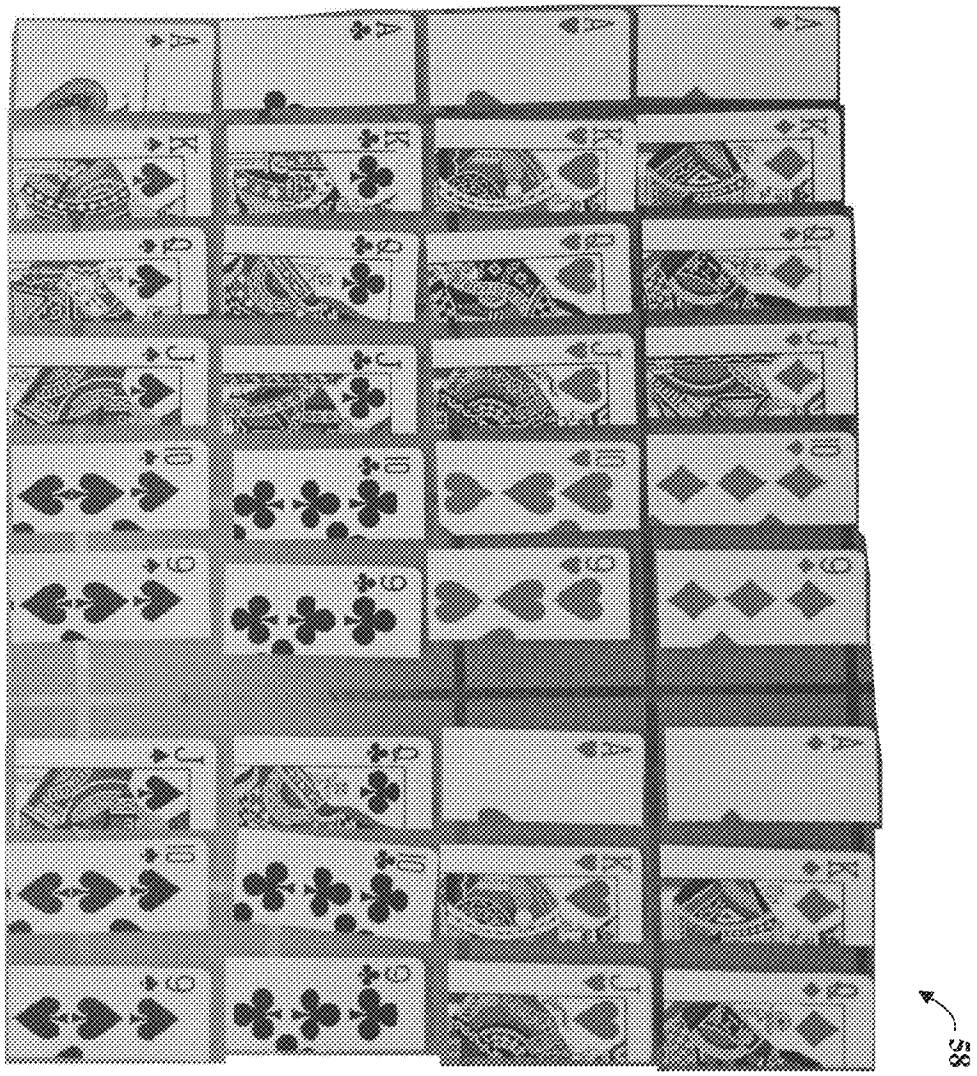

FIGS. 30-33 are illustrations of a set 160 of dice 162 that may be used in playing a game. In one embodiment, the dice 162 may be virtual dice that are generated and used by the system 10 for providing a game to a player. In another embodiment, the dice 162 may be physical dice that may be used by a player in playing a game. FIGS. 34 and 35 are illustrations of set 160 playing card symbols 58 that are included with the dice 162.

In the illustrated embodiment, the set 160 of dice 162 includes a plurality of dice 162 that each display a plurality of playing card symbols 58. The plurality of playing card symbols 58 include card symbols 58 having a rank selected from a group including Ace, King, Queen, Jack, Ten, and Nine, and a suit selected from a group including "Hearts", Diamonds", "Clubs", and "Spades". In one embodiment, the set 160 of dice 162 include 6-dice. Alternatively, the set 160 of dice 162 may include any suitable number of dice 162. In the illustrated embodiment, each die 162 includes 6-sides 164 and displays a group of playing card symbols 58. Each side 164 includes a face 166 that displays a playing card symbol 58. For example, each face 166 may display a rank image 130 and a suit image 132 of the corresponding card symbol 58. In one embodiment, as shown in FIG. 34, at least two dice 162 display different groups of card symbols 58. For example, the set 160 of dice 162 may include a first die 168 and a second die 170 (shown in FIG. 33). The first die 168 displays a first group 172 of playing card symbols 58 (shown in FIG. 34), and the second die 170 displays a second group 174 of playing card symbols 58. The first group 172 includes playing card symbols 58 that are different than the playing card symbols 58 included in the second group 174.

The playing card symbols 58 being displayed with the set 160 of dice 162 may be illustrated in the following Table 4.

TABLE 4

Playing Card Symbols Displayed in Dice Set

| Die No. | Face #1 | Face #2 | Face #3 | Face #4 | Face #5 | Face #6 |
|---|---|---|---|---|---|---|
| 1 | Ace of Hearts | King of Diamonds | Queen of Clubs | Jack of Clubs | Ten of Dia-monds | Nine of Spades |
| 2 | Ace of Spades | King of Hearts | Queen of Diamonds | Jack of Spades | Ten of Clubs | Nine of Diamonds |
| 3 | Ace of Diamonds | King of Spades | Queen of Hearts | Jack of Hearts | Ten of Spades | Nine of Clubs |
| 4 | Ace of Clubs | King of Diamonds | Queen of Spades | Jack of Hearts | Ten of Clubs | Nine of Spades |
| 5 | Ace of Hearts | King of Clubs | Queen of Diamonds | Jack of Spades | Ten of Hearts | Nine of Clubs |
| 6 | Ace of Diamonds | King of Hearts | Queen of Clubs | Jack of Dia-monds | Ten of Spades | Nine of Hearts |

The first column represents the corresponding die 162 in the set 160 of dice 162. The second, third, fourth, fifth, sixth, and seventh columns include the card symbol value being displayed on the corresponding dice face 166.

In the illustrated embodiment, the set 160 of dice 162 include the same ranks and suits and the deck 100 of playing cards 102, including 6 total Ranks (9, 10, J, Q, K, A) and 4 total Suits (Clubs, Diamonds, Spades, Heart.). 6 Ranks and 4 Suits. In the Deck Design a group including a set of diamonds, Ace-9, a set of hearts Ace-9, a set of clubs, Ace-9, and a set of spades, Ace-9 is repeated twice and then half this group is added (24+24+12=60), 60/3=20 cards. In the set of dice, this group is used only once and then half the group is added in (24+12=36) 36/6=6 dice. FIG. 35 illustrates all 24 card symbols plus half=dice group. FIG. 34 illustrates the Dice group re-arranged into groups of 6.

Figure 30:
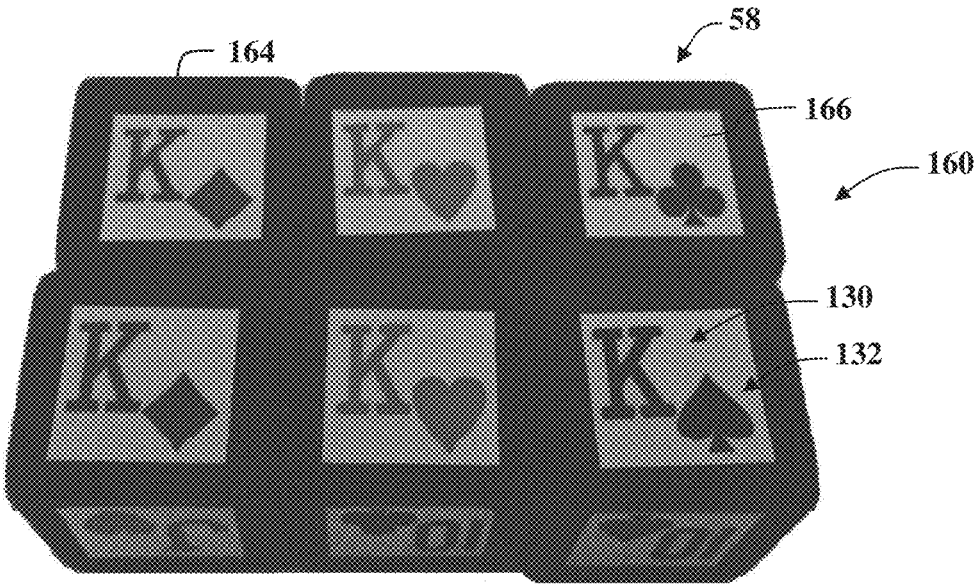
FIGS. 30-33 are illustrations of a set of dice that may be used for playing a game, according to an embodiment of the present invention.
Figure 31:
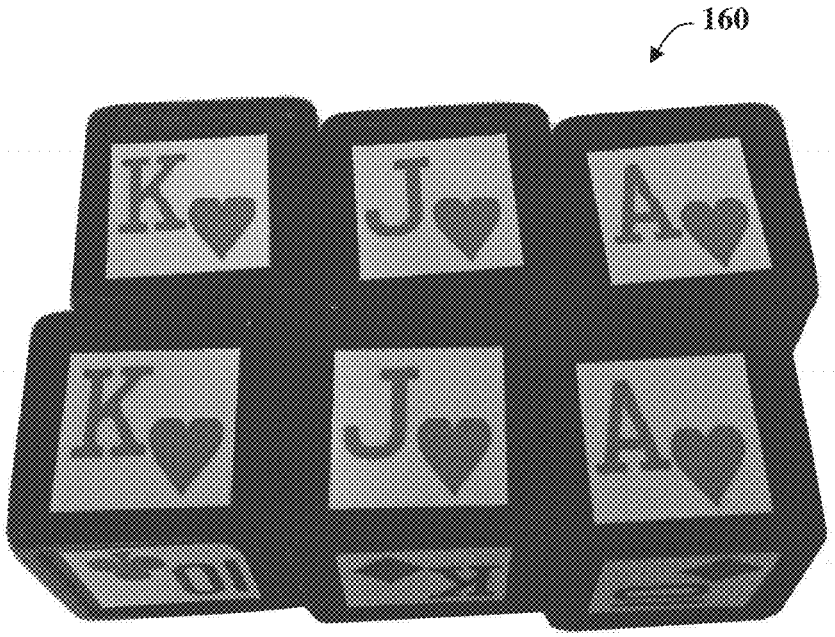
Figure 32:
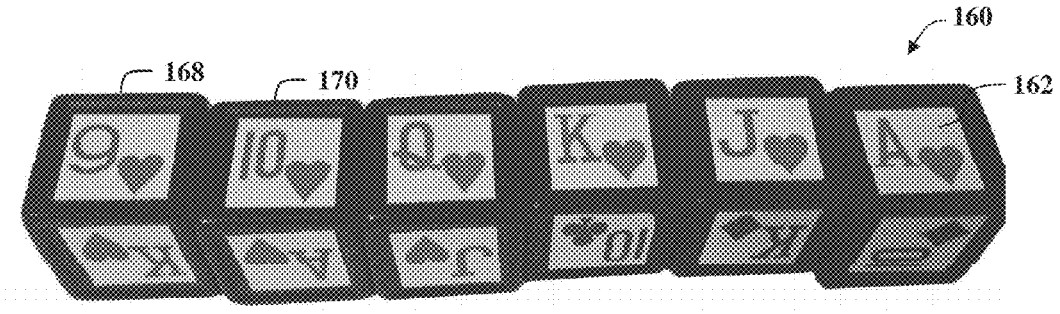
Figure 33:
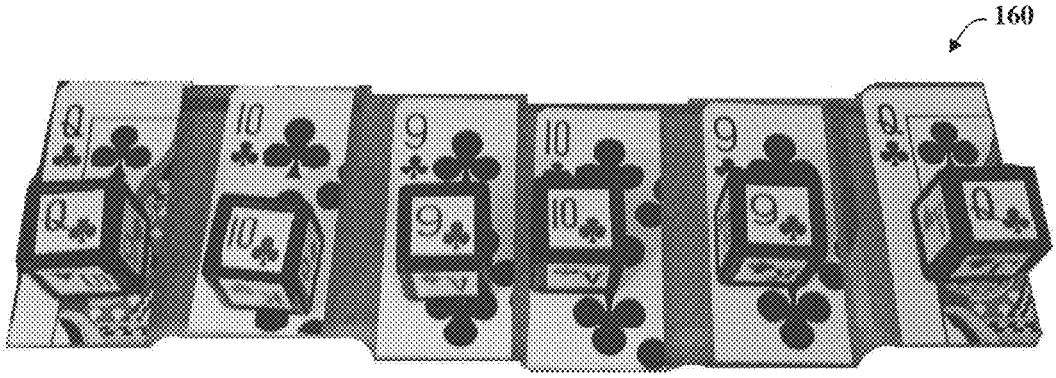

In one embodiment, each dice has 9, 10, J Q, K, A (shown in FIG. 33). Each dice has 2 of one suit, 2 of another suit and 1 of each of the other two suits (shown in FIG. 33). Each suit can be represented as a straight flush (shown in FIG. 32). Each suit can also be made as 3-pairs of the same suit (shown in FIG. 31). Each Rank has 2 of one suit, 2 of another suit and 1 of each of the other two suits (FIG. 30).

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

Those skilled in the art will readily appreciate that the methods described herein may be incorporated in a system in accordance with the invention using virtual representations of gaming implements. The methods and systems of the invention may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The methods and systems of the invention may be provided on electronic platforms with multiple player positions. In addition, the methods and systems of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with access thereto or the opportunity to play and wager on the games as described herein.

While exemplary methods and applications of the methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the present invention in any way. Accordingly, the invention embraces alternatives, modifications and variations which fall within the spirit and scope of the invention as set forth in the embodiments herein and equivalents thereto.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A deck of playing cards for use in playing a game, comprising:

twenty playing cards including a plurality of card symbols selected from a set of card symbols;

wherein each playing card includes three card symbols, each card symbol having an associated rank and suit;

wherein each of the three card symbols included with a corresponding playing card includes a different card value;

wherein two of the three card symbols included with a corresponding playing card includes the same suit;

wherein each of the three card symbols included with a different card rank; and wherein the set of card symbols includes at least twenty-four different card symbols.

2. A deck of playing cards in accordance with claim 1, wherein at least two playing cards of the twenty playing cards have at least one card symbol being the same.

3. A deck of playing cards in accordance with claim 1, wherein the three card symbols included with a corresponding playing card are displayed in order of descending rank.

4. A deck of playing cards in accordance with claim 1, each of the playing cards including a pair cards symbols having different suits.

5. A deck of playing cards in accordance with claim 1, wherein the set of card symbols includes:

fifteen card symbols including a suit of Hearts;

fifteen card symbols including a suit of Diamonds;

fifteen card symbols including a suit of Clubs; and fifteen card symbols including a suit of Spades.

6. A deck of playing cards in accordance with claim 1, each of the card symbols including an associated rank selected from a predefined group of rank values.

7. A deck of playing cards in accordance with claim 1, wherein each of the three card symbols are displayed on a front side of a corresponding playing card and orientated in a first direction, and spaced along a longitudinal axis between a front edge and a side edge of the corresponding playing card.

8. A deck of playing cards in accordance with claim 1, wherein each card symbol includes a summary image and a detailed image, the summary image including a face image or a pip image, the detailed image including a rank and a suit.

9. A deck of playing cards in accordance with claim 8, wherein the detailed images is positioned above the summary image.

10. A deck of playing cards in accordance with claim 1, the plurality of card symbols including at least twelve card symbols having the same suit and at least five card symbols having the same rank.

11. A deck of playing cards in accordance with claim 10, wherein the twenty playing cards includes ten playing cards having suited consecutive pairs of card symbols.

12. One or more non-transitory computer-readable storage media, having computer-executable instructions embodied thereon, wherein when executed by at least one processor, the computer-executable instructions cause the processor to:

receive requests to initiate a game from a plurality of gaming machines associated with a plurality of participating players, each gaming machine including an acceptor device configured to accept physical media associated with a monetary value to establish a credit balance that may be used by a corresponding player to place a wager on the game;

receive a signal from at least one of the gaming machines indicating a wager being made by at least one of the participating players and adjust a corresponding credit balance;

distribute at least one player card to each of the participating players, each player card being selected from a deck of playing cards, the deck of playing cards including twenty playing cards including a plurality of card symbols selected from a set of card symbols, wherein each playing card includes three card symbols, each card symbol having an associated rank and suit, wherein each of the three card symbols included with a corresponding playing card includes a different card value, wherein two of the three card symbols included with a corresponding playing card includes the same suit, wherein each of the three card symbols included with a different card rank, and wherein the set of card symbols includes at least twenty-four different card symbols;

distribute at least one community card from the deck of playing cards;

determine a hand value of each player hand as a function of the card symbols being displayed with the at least one community card and the card symbols being displayed with the corresponding at least one player card;

determine a winning player hand as a function of the corresponding hand value; and settle each wager by either awarding a payout amount to the winning player or collecting the wager.

* * * * *